US009934654B2

(12) United States Patent
Kanbayashi et al.

(10) Patent No.: US 9,934,654 B2
(45) Date of Patent: Apr. 3, 2018

(54) MEDIUM TRANSACTION DEVICE

(71) Applicant: Oki Electric Industry Co., Ltd., Tokyo (JP)

(72) Inventors: Mamoru Kanbayashi, Tokyo (JP); Hajime Togiya, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 15/328,542

(22) PCT Filed: Jun. 12, 2015

(86) PCT No.: PCT/JP2015/067076

§ 371 (c)(1),
(2) Date: Jan. 24, 2017

(87) PCT Pub. No.: WO2016/038962

PCT Pub. Date: Mar. 17, 2016

(65) Prior Publication Data

US 2017/0249807 A1 Aug. 31, 2017

(30) Foreign Application Priority Data

Sep. 11, 2014 (JP) ..... 2014-185324

(51) Int. Cl.
*G07D 11/00* (2006.01)
*G07F 19/00* (2006.01)

(52) U.S. Cl.
CPC ..... *G07F 19/202* (2013.01); *G07D 11/0006* (2013.01); *G07D 11/0021* (2013.01);
(Continued)

(58) Field of Classification Search
CPC ..... G07D 11/0081; G07D 11/0018; G07D 11/0021; G07F 19/202
See application file for complete search history.

(56) References Cited

U.S. PATENT DOCUMENTS 6,170,822 B1 1/2001 Kato et al.
6,474,549 B2 * 11/2002 Katou ..... B65H 29/006 235/379

(Continued)

FOREIGN PATENT DOCUMENTS

JP 2004272606 A * 9/2004
JP 2006-120180 A 5/2006

(Continued)

*Primary Examiner* — Luis A Gonzalez
(74) *Attorney, Agent, or Firm* — Rabin & Berdo, P.C.

(57) ABSTRACT

A medium transaction device includes: a conveyance section for a medium; a customer interface attachment point; a classification section attachment point; a storage section attachment point; and a controller that controls transaction processing of the medium with the user. At least one of the customer interface attachment point, the classification section attachment point, or the storage section attachment point is configured to allow attachment of one type of the customer interface, the classification section, or the storage section from plural mutually different respective functional types thereof. The controller switches the transaction processing executable with the user according to the type of the customer interface, the classification section, or the storage section that is attached to the customer interface attachment point, the classification section attachment point, or the storage section attachment point.

7 Claims, 32 Drawing Sheets

(52) U.S. Cl.
CPC ..... *G07D 11/0033* (2013.01); *G07D 11/0081* (2013.01); *G07F 19/203* (2013.01)

(56) References Cited

U.S. PATENT DOCUMENTS

| | | | | |
|---|---|---|---|---|
| 7,249,707 | B2 * | 7/2007 | Yokoi | G07D 11/0012 235/379 |
| 7,559,460 | B2 * | 7/2009 | Burns | G07D 11/0018 235/379 |
| 8,978,866 | B2 * | 3/2015 | Kumagai | G07D 11/0084 194/206 |
| 2016/0314446 | A1 * | 10/2016 | Kim | G06Q 20/1085 |

FOREIGN PATENT DOCUMENTS

| | | | |
|---|---|---|---|
| JP | 2006-190333 | A | 7/2006 |
| JP | 2011-002912 | A | 1/2011 |

* cited by examiner

FIG.11

TBL1

| OPERATION MODE | HIGH FUNCTIONALITY MODE | LOW FUNCTIONALITY MODE |
|---|---|---|
| CUSTOMER INTERFACE | HIGH FUNCTIONALITY CUSTOMER INTERFACE | HIGH FUNCTIONALITY CUSTOMER INTERFACE OR LOW FUNCTIONALITY CUSTOMER INTERFACE |
| CLASSIFICATION SECTION | HIGH FUNCTIONALITY CLASSIFICATION SECTION | HIGH FUNCTIONALITY CLASSIFICATION SECTION OR LOW FUNCTIONALITY CLASSIFICATION SECTION |
| TEMPORARY HOLDING SECTION | MOUNTED | MOUNTED OR NOT MOUNTED |
| BANKNOTE STORAGE BOXES | HIGH FUNCTIONALITY BANKNOTE STORAGE BOXES | HIGH FUNCTIONALITY BANKNOTE STORAGE BOXES OR LOW FUNCTIONALITY BANKNOTE STORAGE BOXES |

FIG. 15

TBL2

| OPERATION MODE | HIGH FUNCTIONALITY MODE | SEMI-LOW FUNCTIONALITY MODE | LOW FUNCTIONALITY MODE |
|---|---|---|---|
| CUSTOMER INTERFACE | HIGH FUNCTIONALITY CUSTOMER INTERFACE | HIGH FUNCTIONALITY CUSTOMER INTERFACE OR LOW FUNCTIONALITY CUSTOMER INTERFACE | HIGH FUNCTIONALITY CUSTOMER INTERFACE OR LOW FUNCTIONALITY CUSTOMER INTERFACE |
| CLASSIFICATION SECTION | HIGH FUNCTIONALITY CLASSIFICATION SECTION | HIGH FUNCTIONALITY CLASSIFICATION SECTION OR LOW FUNCTIONALITY CLASSIFICATION SECTION | HIGH FUNCTIONALITY CLASSIFICATION SECTION OR LOW FUNCTIONALITY CLASSIFICATION SECTION |
| TEMPORARY HOLDING SECTION | MOUNTED | MOUNTED | NOT MOUNTED |
| BANKNOTE STORAGE BOXES | HIGH FUNCTIONALITY BANKNOTE STORAGE BOXES | HIGH FUNCTIONALITY BANKNOTE STORAGE BOXES OR LOW FUNCTIONALITY BANKNOTE STORAGE BOXES | HIGH FUNCTIONALITY BANKNOTE STORAGE BOXES OR LOW FUNCTIONALITY BANKNOTE STORAGE BOXES |

FIG.20

TBL3

| FORGOTTEN-BANKNOTE TAKE-IN FLAG | | CUSTOMER INTERFACE | |
|---|---|---|---|
| | | HIGH FUNCTIONALITY CUSTOMER INTERFACE | LOW FUNCTIONALITY CUSTOMER INTERFACE |
| FORGOTTEN-BANKNOTE STORAGE BOX | MOUNTED | ON | OFF |
| | NOT MOUNTED | OFF | OFF |

FIG.27

TBL4

| OPERATION MODE | HIGH FUNCTIONALITY MODE | SEMI-HIGH FUNCTIONALITY MODE | LOW FUNCTIONALITY MODE |
|---|---|---|---|
| CUSTOMER INTERFACE | HIGH FUNCTIONALITY CUSTOMER INTERFACE | HIGH FUNCTIONALITY CUSTOMER INTERFACE | HIGH FUNCTIONALITY CUSTOMER INTERFACE OR LOW FUNCTIONALITY CUSTOMER INTERFACE |
| CLASSIFICATION SECTION | HIGH FUNCTIONALITY CLASSIFICATION SECTION | HIGH FUNCTIONALITY CLASSIFICATION SECTION | HIGH FUNCTIONALITY CLASSIFICATION SECTION OR LOW FUNCTIONALITY CLASSIFICATION SECTION |
| TEMPORARY HOLDING SECTION | MOUNTED | NOT MOUNTED | MOUNTED OR NOT MOUNTED |
| BANKNOTE STORAGE BOXES | HIGH FUNCTIONALITY BANKNOTE STORAGE BOXES | HIGH FUNCTIONALITY BANKNOTE STORAGE BOXES | HIGH FUNCTIONALITY BANKNOTE STORAGE BOXES OR LOW FUNCTIONALITY BANKNOTE STORAGE BOXES |

MEDIUM TRANSACTION DEVICE

TECHNICAL FIELD

This application claims priority from Japanese Patent Application No. 2014-185324, filed on Sep. 11, 2014, the disclosure of which is incorporated in its entirety by reference herein.

The present invention relates to a medium transaction device, and may, for example, be applied to an Automatic Teller Machine (ATM) that handles banknotes as a medium.

BACKGROUND ART

ATMs and the like are widely employed, for example in financial institutions, to allow a user to pay in cash such as banknotes and coins, and to pay out cash to the user, according to contents of a transaction with the user.

As an example of such an ATM, a proposed ATM includes, for example, a customer interface that hands over or receives banknotes from a user, a conveyance section that conveys banknotes, a classification section that classifies banknotes, a temporary holding section that temporarily holds banknotes, banknote storage boxes that store banknotes by denomination, and a controller that performs overall control (see, for example, Japanese Patent Application Laid-open (JP-A) No. 2011-2912 (FIG. 1)).

In a pay-in transaction of the ATM, for example, banknotes inserted into the customer interface by the user are separated and taken in one note at a time, conveyed to the classification section by the conveyance section and classified, and stored in the temporary holding section after a conveyance destination has been decided by the controller based on results of the classification. The ATM then conveys the banknotes stored in the temporary holding section to their respectively decided conveyance destinations to be stored.

Moreover, in a pay-out transaction, for example, the ATM receives a pay-out amount instruction from the user, feeds out banknotes from the banknote storage boxes in denominations and numbers corresponding to the pay-out amount, uses the conveyance section to convey the banknotes to the classification section to be classified, and conveys banknotes that are being conveyed correctly to the customer interface to allow the user to take the banknotes corresponding to the pay-out amount.

SUMMARY OF INVENTION

Technical Problem

In addition to ATMs, devices that transact cash with a user in a financial institution or the like include cash dispensers (CDs) that only perform pay-out transactions. Compared to ATMs, such CDs lack functions relating to pay-in transactions, and are therefore simpler in structure and enable installation costs to be kept low.

However, in consideration of the needs of users, costs, and the like, sometimes a financial institution or the like will initially install a CD, and later want to enable pay-in transactions and the like, for example according to changes in the usage patterns of users.

Hitherto, however, CDs have been designed exclusively for paying out, and it has not been possible to add additional pay-in transaction functions later. In other words, there has been no consideration given to, for example, compatibility between ATMs and CDs, with both having exclusive designs.

Accordingly, in order to enable pay-in transactions, it is necessary to replace the CD with an ATM, which involves swapping all of the components configuring the CD. This is wasteful, and results in escalating costs.

In consideration of the above circumstances, the present invention proposes a medium transaction device in which the types of transactions that are executable may easily be changed.

Solution to Problem

A medium transaction device of a first aspect of the present invention is provided with: a conveyance section that conveys a medium; a customer interface attachment point for attaching a customer interface to a casing, the customer interface including at least one of a handover function to receive the medium from the conveyance section and hand over the medium to a user and a receiving function to receive the medium from the user and pass the medium across to the conveyance section; a classification section attachment point for attaching, to the casing, a classification section that classifies the medium conveyed by the conveyance section; a storage section attachment point for attaching, to the casing, a storage section that stores the medium; and a controller that controls transaction processing of the medium with the user. At least one of the customer interface attachment point, the classification section attachment point, or the storage section attachment point is configured so as to allow attachment of plural mutually different respective functional types of the customer interface, the classification section, or the storage section, and so as to be attached with one type of the customer interface, the classification section, or the storage section. The controller switches the transaction processing executable with the user according to the type of the customer interface, the classification section, or the storage section that is attached to the customer interface attachment point, the classification section attachment point, or the storage section attachment point.

The present aspect enables the transaction processing executable with a user to be switched without exchanging the entire device, by swapping over at least one of the type of the customer interface attached to the customer interface attachment point, the type of the classification section attached to the classification section attachment point, or the type of the storage section attached to the storage section attachment point.

Effects of Invention

The present aspect enables a medium transaction device in which the types of transitions that are executable may easily be changed.

BRIEF DESCRIPTION OF DRAWINGS

FIG. 11 is a schematic drawing illustrating of an operation mode table according to the first exemplary embodiment.

FIG. 15 is a schematic drawing illustrating an operation mode table according to the second exemplary embodiment.

FIG. 20 is a schematic drawing illustrating configuration of a forgotten-banknote take-in flag table according to the third exemplary embodiment.

FIG. 27 is a schematic drawing illustrating configuration of an operation mode table according to the fourth exemplary embodiment.

DESCRIPTION OF EMBODIMENTS

Explanation follows regarding exemplary embodiments, with reference to the drawings.

1. First Exemplary Embodiment

1-1. ATM Configuration

Figure 1:
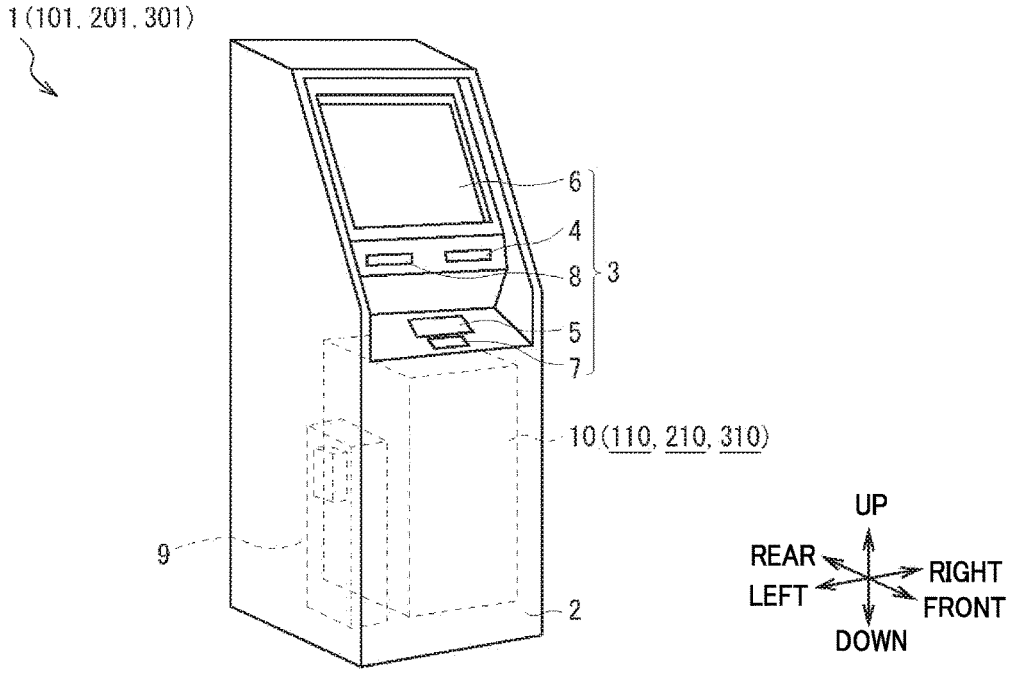
FIG. 1 is a perspective view schematically illustrating an external configuration of an ATM.

As illustrated in external view in FIG. 1, an ATM 1 is configured by a box shaped casing 2 as a main component, and is, for example, installed in a financial institution or the like. The ATM 1 performs cash transactions such as pay-in processing and pay-out processing with a customer.

The casing 2 includes a customer interface 3 at a location enabling easy banknote insertion, easy operation of a touch panel, and the like by a customer facing the front side of the casing 2. The customer interface 3 is provided with a card insertion/removal port 4, a pay-in/pay-out port 5, an operation and display section 6, a ten-key 7, and a receipt issue port 8. The customer interface 3 directly handles cash and cash card transactions with the customer, for example, and notifies transaction-related information and receives operation instructions.

The card insertion/removal port 4 is a section where various cards, such as cash cards, are inserted and returned. A card processor (not illustrated in the drawings) that reads, for example, account numbers magnetically recorded on the various cards is provided inside casing of the card insertion/removal port 4. The pay-in/pay-out port 5 is a section where banknotes paid in by a customer are inserted, and where banknotes for paying out to a customer are dispensed. A shutter is driven to open and close the pay-in/pay-out port 5.

The operation and display section 6 is integrated with a Liquid Crystal Display (LCD) that displays operation screens during transactions, and a touch panel that is input with, for example, a transaction type selection, a PIN, or a transaction amount. The ten-key 7 is a physical keypad that is input with, for example, the numbers 0 to 9. The ten-key 7 is employed during PIN and transaction amount input operations and the like. The receipt issue port 8 is a section that issues a receipt printed with transaction details and the like at the end of transaction processing. A receipt processor (not illustrated in the drawings) that prints transaction details and the like on a receipt is provided inside casing of the receipt issue port 8.

In the following explanation, the front side is defined as the side of the ATM 1 that a customer faces, and the opposite side thereto is defined as the rear side. The left side, right side, upper side and lower side are defined from the perspective of the left and right as seen by a customer facing the front side.

A front door (not illustrated in the drawings) that covers a lower side of a front face of the casing 2 is configured capable of opening and closing. For example, the front door of the casing 2 is closed in order to protect internally stored banknotes, coins, and the like during transaction operations in which cash transactions are performed with a customer. The front door of the casing 2 is opened as required in order to facilitate operations on the respective internal sections when a member of staff of the financial institution or a technician performs tasks such as maintenance operations or banknote replenishment or retrieval operations.

A main controller 9 that performs general control of the overall ATM 1, a banknote pay-in/pay-out device 10 that performs various processing relating to banknotes, and the like, are provided inside the casing 2.

The main controller 9 is mainly configured by a Central Processing Unit (CPU), not illustrated in the drawings. The main controller 9 reads and executes specific programs from Read Only Memory (ROM), flash memory, or the like to perform various processing in pay-in transactions, pay-out transactions, and the like. The main controller 9 includes an internal storage section including Random Access Memory (RAM), a hard disk drive, flash memory, or the like. The storage section is stored with various information.

1-2. Banknote Pay-In/Pay-Out Device Configuration

Figure 2:
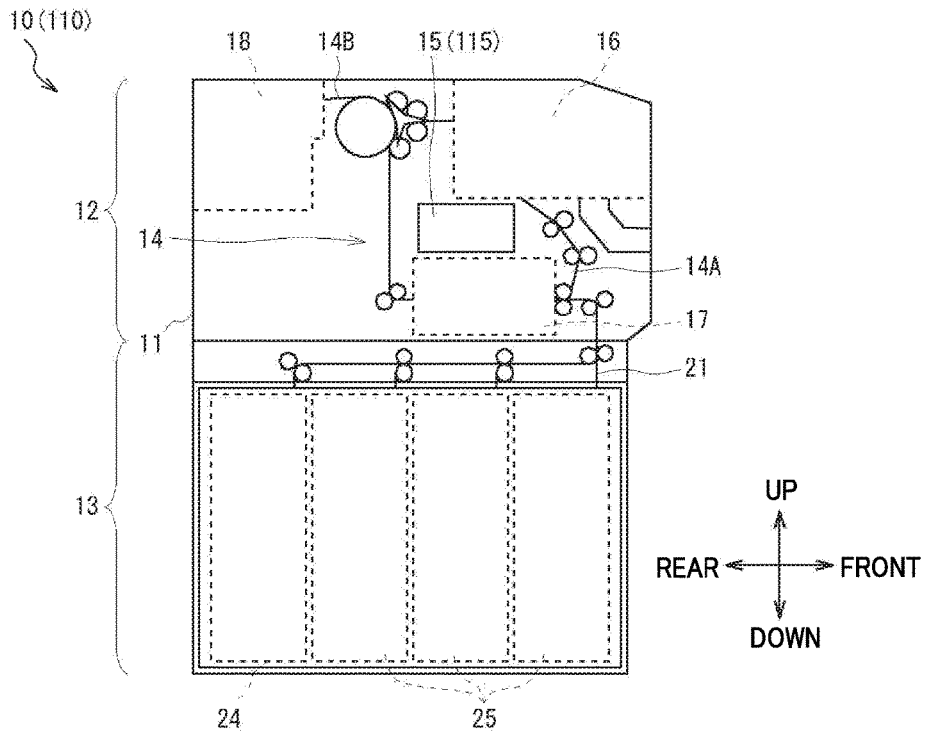
FIG. 2 is schematic view illustrating configuration of a banknote pay-in/pay-out device according to a first exemplary embodiment.

As schematically illustrated in side view in FIG. 2, the banknote pay-in/pay-out device 10 is incorporated with various mechanisms for performing pay-in processing and pay-out processing on banknotes inside the banknote pay-in/pay-out device casing 11. The banknote pay-in/pay-out device 10 is configured split broadly into an upper section unit 12 at an upper side, and a lower section unit 13 at a lower side.

The upper section unit 12 is incorporated with an upper conveyance section 14 that conveys banknotes internally, as well as a banknote controller 15, a customer interface attachment point 16, a classification section attachment point 17, and a temporary holding section attachment point 18.

As partially illustrated in schematic view, the upper conveyance section 14 is configured by a motor, rollers, belts, guides, and the like, and forms conveyance paths (indicated by continuous lines in the drawings) linking together the respective sections inside the upper section unit 12. The upper conveyance section 14 conveys banknotes along the conveyance paths by rotating the rollers as appropriate and moving the belts as appropriate. In the upper conveyance section 14, switching devices are disposed at locations where the conveyance paths branch and connect, and the banknote conveyance paths are switched as appropriate using the switching devices.

The upper conveyance section 14 is configured, as main parts, by a front conveyance section 14A positioned at the front side of the classification section attachment point 17, and a rear conveyance section 14B positioned at the rear side of the classification section attachment point 17. The front conveyance section 14A configures banknote conveyance paths linking between the lower side of the customer interface attachment point 16 and the front side of the classification section attachment point 17, and between the front side of the classification section attachment point 17 and a lower conveyance section 21 (described in detail later) of the lower section unit 13. The rear conveyance section 14B configures banknote conveyance paths linking together the rear side of the classification section attachment point 17, the rear side of the customer interface attachment point 16, and the front side of the temporary holding section attachment point 18.

The banknote controller 15 works together with the main controller 9 to perform general control of the banknote pay-in/pay-out device 10. Similarly to the main controller 9, the banknote controller 15 is mainly configured by a CPU, not illustrated in the drawings, and reads and executes specific programs from ROM, flash memory, and the like, not illustrated in the drawings, in order to control various processing relating to banknotes, such as banknote pay-in processing and pay-out processing. The banknote controller 15 further includes an internal storage section configured by RAM, flash memory, or the like. The storage section is stored with various information.

Figure 3A:
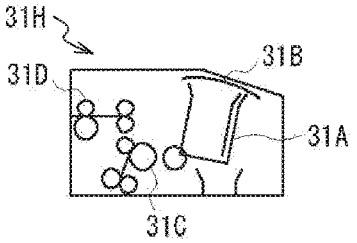
FIG. 3A is a schematic drawing illustrating configuration of a module according to the first exemplary embodiment.
Figure 3B:
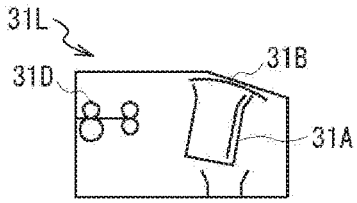
FIG. 3B is a schematic drawing illustrating configuration of a module according to the first exemplary embodiment.

The customer interface attachment point 16 is attached with either a high functionality customer interface 31H, illustrated in FIG. 3A, or a low functionality customer interface 31L, illustrated in FIG. 3B (both are also referred to collectively as the customer interface 31 below). Specifically, the customer interface attachment point 16 is configured by, for example, a space in which to place the customer interface 31, a fixing member (not illustrated in the drawings) for fixing the customer interface 31 to the banknote pay-in/pay-out device casing 11, and a connector (not illustrated in the drawings) for electrically connecting the customer interface 31 to the banknote controller 15 and the like. The classification section attachment point 17, the temporary holding section attachment point 18, and banknote storage attachment points 25, described later, are also configured in a similar manner.

Figure 4A:
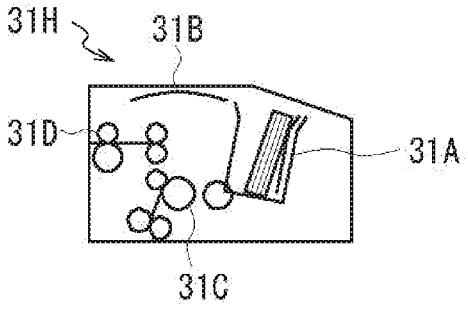
FIG. 4A is a schematic drawing illustrating swinging of a receptacle of a customer interface.
Figure 4B:
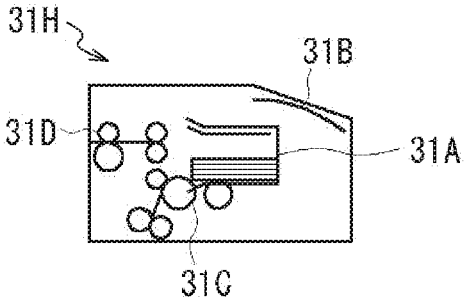
FIG. 4B is a schematic drawing illustrating swinging of a receptacle of a customer interface.

The high functionality customer interface 31H (FIG. 3A) includes an internal receptacle 31A, and also includes a shutter 31B at the upper side of the receptacle 31A. The receptacle 31A is formed in a rectangular block shape open at an upper portion, and receives banknotes to be handed to a user or banknotes received from a user. The shutter 31B moves in a front-rear direction to open and close an opening formed in an upper face of the high functionality customer interface 31H, as illustrated in FIG. 4A and FIG. 4B.

The high functionality customer interface 31H swings the receptacle 31A about a swing shaft, not illustrated in the drawings. The receptacle 31A is accordingly capable of transitioning between a receiving/dispensing state in which a bottom face of the receptacle 31A is substantially horizontal, as illustrated in FIG. 4A, and a separation and discharge state in which the bottom face is substantially aligned with a vertical direction, as illustrated in FIG. 4B.

The high functionality customer interface 31H (FIG. 3A) includes a separation section 31C and a discharge section 31D at the lower side and the rear side of the receptacle 31A, respectively. The separation section 31C includes plural rollers, such as pick-up rollers and conveyance rollers, and when the receptacle 31A is in the separation and discharge state, the separation section 31C uses the pick-up rollers to separate banknotes inside the receptacle 31A one note at a time, and uses the conveyance rollers to convey the banknotes and pass the banknotes across to the front conveyance section 14A positioned below. When the receptacle 31A is in the separation and discharge state, the discharge section 31D discharges banknotes conveyed from the rear conveyance section 14B, positioned at the rear side, and stacks the banknotes inside the receptacle 31A.

The high functionality customer interface 31H configured in this manner is capable of performing two customer service operations, namely a pay-out customer service operation and a pay-in customer service operation. Specifically, in the pay-out customer service operation, the high functionality customer interface 31H first places the receptacle 31A in the separation and discharge state, and uses the discharge section 31D to discharge banknotes conveyed from the rear conveyance section 14B, positioned at the rear side, and stack the banknotes inside the receptacle 31A. The high functionality customer interface 31H then transitions the receptacle 31A to the receiving/dispensing state and opens the shutter 31B, allowing the banknotes to be handed over to the user, namely paid out. This functionality is referred to below as the handover function.

In the pay-in customer service operation, the high functionality customer interface 31H places the receptacle 31A in the receiving/dispensing state, and opens the shutter 31B to allow the user to insert banknotes in the receptacle 31A. The high functionality customer interface 31H then closes the shutter 31B, transitions the receptacle 31A to the separation and discharge state, and passes the banknotes inside the receptacle 31A across to the front conveyance section 14A positioned at the lower side, while separating the banknotes one note at a time using the separation section 31C. This thereby enables banknotes to be received from the user, namely paid in. This functionality is referred to below as the receiving function. Namely, the high functionality customer interface 31H includes both the handover function and the receiving function.

The low functionality customer interface 31L (FIG. 3B) has a configuration similar to that of the high functionality customer interface 31H, but with the separation section 31C omitted. As a customer service operation, the low functionality customer interface 31L is only capable of performing the pay-out customer service operation, and is not capable of performing the pay-in customer service operation. Namely, the low functionality customer interface 31L only includes the handover function.

Figure 3C:
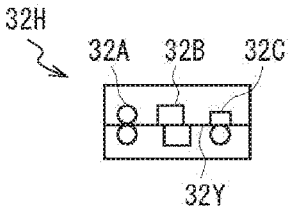
FIG. 3C is a schematic drawing illustrating configuration of a module according to the first exemplary embodiment.

The classification section attachment point 17 is attached with either a high functionality classification section 32H, illustrated in FIG. 3C, or a low functionality classification section 32L, illustrated in FIG. 3D (both are also referred to collectively as the classification section 32 below).

In the high functionality classification section 32H (FIG. 3C), rollers, conveyance guides, and the like, not illustrated in the drawings, form a banknote conveyance path 32Y running along the front-rear direction. In the high functionality classification section 32H, a thickness sensor 32A, an image sensor 32B, and a magnetic sensor 32C are disposed along the banknote conveyance path 32Y, in sequence from the rear side.

The thickness sensor 32A detects the thickness of conveyed banknotes, and supplies a detection result to the banknote controller 15. As banknote conveyance states, the banknote controller 15 is capable of determining whether a banknote is being conveyed correctly, namely separated as a single note and not overlapping with any other banknotes, or whether two or more banknotes are being conveyed overlapping with each other, based on the detection result acquired from the thickness sensor 32A.

The image sensor 32B generates respective images by imaging both faces of a conveyed banknote, and outputs the images to the banknote controller 15. The magnetic sensor 32C detects the magnetism of banknotes, and outputs detection results to the banknote controller 15. Based on the images acquired from the image sensor 32B and the detection results acquired from the magnetic sensor 32C, the banknote controller 15 is capable of determining the denomination, authenticity, condition (namely, the degree of damage), and the like of the banknote. In the following explanation, the detection results obtained from the thickness sensor 32A and the magnetic sensor 32C and the images obtained from the image sensor 32B are collectively referred to as classification results.

The banknote controller 15 decides the handling and the conveyance destination of a banknote based on determination results for the conveyance state, denomination, authenticity, condition, and the like of the banknote, and controls the respective sections according to the details of the decision. For example, when a banknote paid in by a user in a pay-in transaction is a banknote that cannot be handled, such as a banknote in a denomination that is not handled or a foreign banknote, the banknote controller 15 conveys the banknote to the customer interface 31, and returns the banknote to the user.

The low functionality classification section 32L (FIG. 3D) has a configuration similar to that of the high functionality classification section 32H, but with the image sensor 32B and the magnetic sensor 32C omitted. Accordingly, when the banknote controller 15 acquires the various detection results from the low functionality classification section 32L, although the banknote controller 15 is capable of determining the conveyance state of the banknote, the banknote controller 15 cannot determine the denomination, authenticity, condition, and the like of the banknote.

Figure 3D:
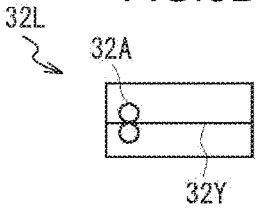
FIG. 3D is a schematic drawing illustrating configuration of a module according to the first exemplary embodiment.
Figure 3E:
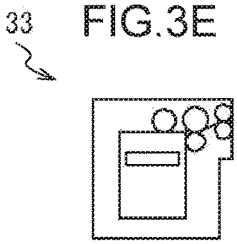
FIG. 3E is a schematic drawing illustrating configuration of a module according to the first exemplary embodiment.

The temporary holding section attachment point 18, serving as a temporary storage section attachment point, is attached with a temporary holding section 33, serving as a temporary storage section, illustrated in FIG. 3E, or is operated in a state in which nothing is attached.

The temporary holding section 33 (FIG. 3E) temporarily stores banknotes conveyed from the rear conveyance section 14B by internally stacking the banknotes in sequence, and feeds out banknotes one note at a time by passing the stored banknotes across to the rear conveyance section 14B in sequence.

In the banknote pay-in/pay-out device 10, when the temporary holding section 33 is mounted to the temporary holding section attachment point 18, banknotes involved in a current transaction may be stored in the temporary holding section 33, and thereby segregated from other banknotes. Conversely in the banknote pay-in/pay-out device 10, when the temporary holding section 33 is not mounted to the temporary holding section attachment point 18, it is not possible to store banknotes involved in a current transaction in a location segregated from other banknotes.

Figure 5:
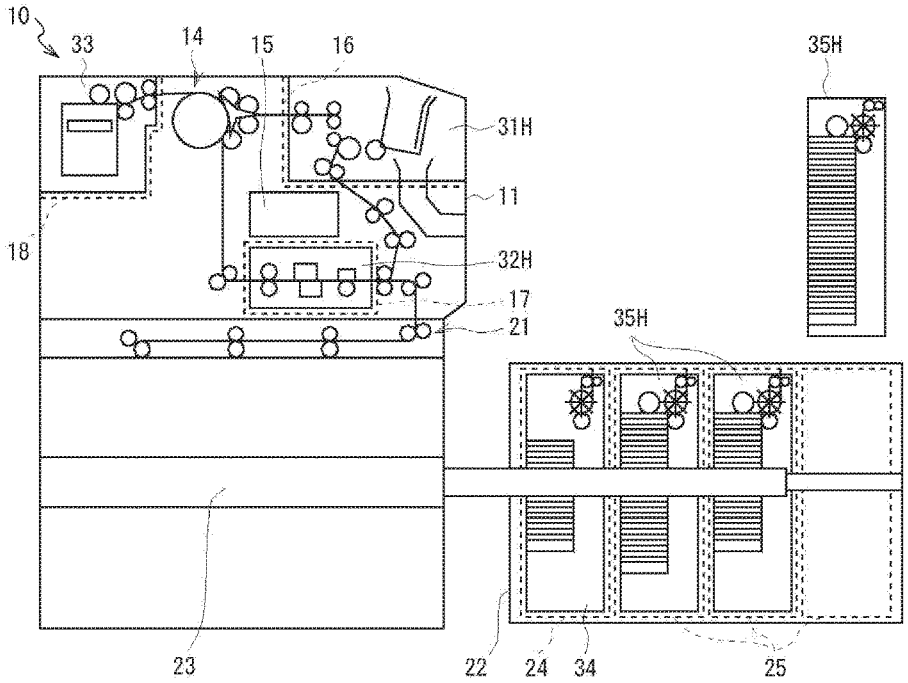
FIG. 5 is a schematic drawing illustrating sliding of a slide unit of a banknote pay-in/pay-out device.

The lower section unit 13 is provided with the lower conveyance section 21 that conveys banknotes in an uppermost portion of the lower section unit 13, and is provided with a slide unit 22 that occupies the lower section unit 13 below the lower conveyance section 21. The slide unit 22 is attached to the banknote pay-in/pay-out device casing 11 through slide rails 23. The slide unit 22 is capable of transitioning between a state stowed inside the banknote pay-in/pay-out device casing 11, as illustrated in FIG. 2, and a state pulled out to the front of the banknote pay-in/pay-out device casing 11, as illustrated in FIG. 5.

The slide unit 22 is formed in a hollow rectangular block shape, is open at an upper face, and is partitioned into plural internal spaces in a row along the front-rear direction. A long, thin rectangular block shaped object running in the up-down direction may be inserted and mounted into each of the spaces from above, and the mounted object may be removed by being pulled out upward. The space formed on the rearmost side inside the slide unit 22 configures a reject box attachment point 24, and the other portions configure the banknote storage attachment points 25.

Figure 3F:
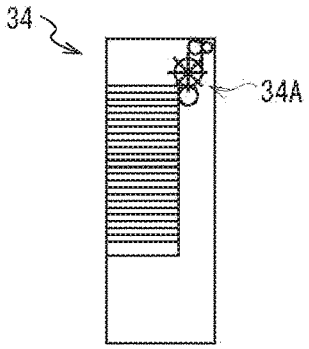
FIG. 3F is a schematic drawing illustrating configuration of a module according to the first exemplary embodiment.

A reject box 34, illustrated in FIG. 3F, is attached to the reject box attachment point 24. The reject box 34 is formed in a rectangular block shape with its length running in the up-down direction overall. A large number of banknotes are stacked and stored in a storage space formed inside the reject box 34. The reject box 34 includes a discharge mechanism 34A that stacks banknotes conveyed by the lower conveyance section 21 by discharging the banknotes into the storage space. The discharge mechanism 34A includes, for example, discharge rollers that nip both faces of a banknote and discharge the banknote into the storage space, and paddle wheels that pat the banknotes onto the top of previously stacked banknotes after being discharged.

Figure 3G:
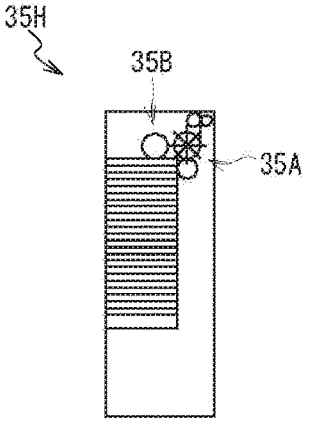
FIG. 3G is a schematic drawing illustrating configuration of a module according to the first exemplary embodiment.
Figure 3H:
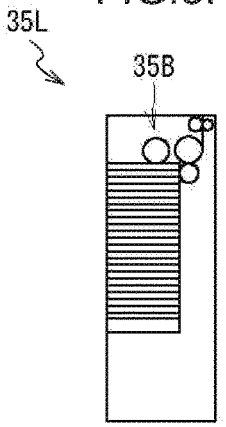
FIG. 3H is a schematic drawing illustrating configuration of a module according to the first exemplary embodiment.

The banknote storage attachment points 25, serving as storage section attachment points, are respectively attached with high functionality banknote storage boxes 35H, illustrated in FIG. 3G, or low functionality banknote storage boxes 35L, illustrated in FIG. 3H (both are also referred to collectively as the banknote storage boxes 35 below). The respective banknote storage boxes 35 attached to each of the banknote storage attachment points 25 store banknotes of preset denominations. For ease of explanation, in the following explanation the banknote storage boxes 35 are also referred to as storage sections.

As illustrated in FIG. 5, in the banknote pay-in/pay-out device 10, the banknote storage boxes 35 may easily be removed from the banknote storage attachment points 25 simply by lifting the banknote storage boxes 35 upward from the slide unit 22 that is in a state pulled out to the front of the banknote pay-in/pay-out device casing 11. Moreover, in the banknote pay-in/pay-out device 10, the banknote storage boxes 35 may be attached (mounted) to the banknote storage attachment points 25 simply by lowering the banknote storage boxes 35 downward from above the banknote storage attachment points 25. Namely, in the banknote pay-in/pay-out device 10, the banknote storage boxes 35 may be easily attached and removed with respect to the banknote storage attachment points 25 without using tools or the like.

The high functionality banknote storage boxes 35H (FIG. 3G) have a similar overall configuration to the reject box 34, and each include a discharge mechanism 35A that is similar to the discharge mechanism 34A, and a separating mechanism 35B that separates and feeds out stacked banknotes one note at a time to the lower conveyance section 21.

The discharge mechanism 35A includes discharge rollers, paddle wheels, and the like, similarly to the discharge mechanism 34A of the reject box 34. The separating mechanism 35B includes gate rollers that separate and pass out banknotes one note at a time, picker rollers that feed stacked banknotes to the gate rollers, and the like. Some of the rollers and the like are common to both the discharge mechanism 35A and the separating mechanism 35B.

In this manner, the high functionality banknote storage boxes 35H are capable of performing a storage operation in which banknotes conveyed by the lower conveyance section 21 are stored in the storage space, and performing a feed-out operation in which banknotes stored in the storage space are fed out to the lower conveyance section 21.

The low functionality banknote storage boxes 35L (FIG. 3H) have a configuration similar to that of the high functionality banknote storage boxes 35H, but with the discharge mechanism 34A omitted. Accordingly, the low functionality banknote storage boxes 35L are capable of performing the feed-out operation, but are not capable of performing the storage operation.

As partially illustrated in schematic view, similarly to the upper conveyance section 14, the lower conveyance section 21 is configured by a motor, rollers, belts, guides, and the like, and forms conveyance paths (indicated by continuous lines in the drawings) linking the upper side of the respective banknote storage attachment points 25 and the upper side of the reject box attachment point 24, and conveys banknotes along this conveyance path. Conveyance paths are mutually connected between a front end of the lower conveyance section 21 and a front side lower end of the front conveyance section 14A.

Accordingly, in the banknote pay-in/pay-out device 10, both high functionality versions and low functionality versions are prepared for the customer interface 31 attached to the customer interface attachment point 16, the classification section 32 attached to the classification section attachment point 17, and the banknote storage boxes 35 attached to the banknote storage attachment points 25. The temporary holding section 33 for attachment to the temporary holding section attachment point 18 is also prepared.

Figure 6:
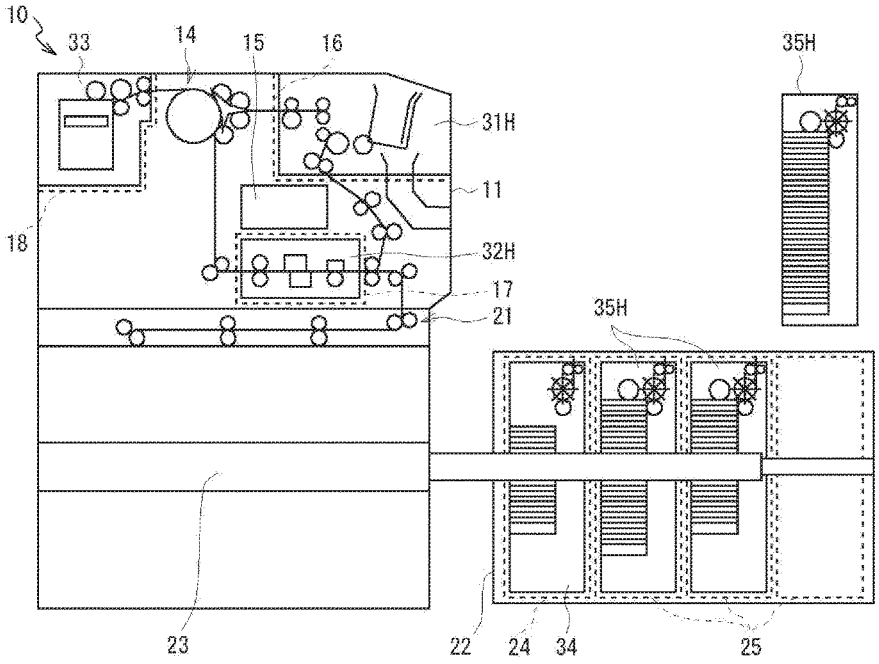
FIG. 6 is a schematic drawing illustrating configuration of a banknote pay-in/pay-out device attached with high functionality versions of respective modules according to the first exemplary embodiment, and illustrating the route taken by banknotes in a pay-in transaction in a high functionality mode.

Accordingly, in the banknote pay-in/pay-out device 10, as illustrated in FIG. 6, for example, configuration may be made in which the high functionality customer interface 31H is attached to the customer interface attachment point 16, the high functionality classification section 32H is attached to the classification section attachment point 17, the high functionality banknote storage boxes 35H are attached to the respective banknote storage attachment points 25, and moreover, the temporary holding section 33 is attached to the temporary holding section attachment point 18.

Figure 7:
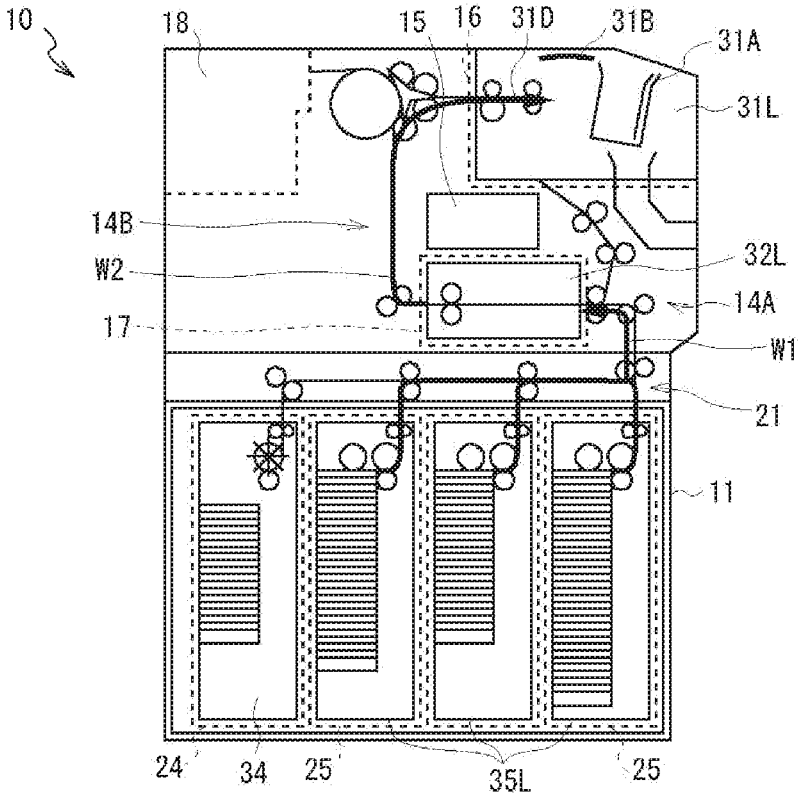
FIG. 7 is a schematic drawing illustrating configuration of a banknote pay-in/pay-out device attached with low functionality versions of respective modules according to the first exemplary embodiment, and illustrating the route taken by banknotes in a pay-out transaction in a low functionality mode.

Moreover, in the banknote pay-in/pay-out device 10, as illustrated in FIG. 7, for example, configuration may be made in which the low functionality customer interface 31L is attached to the customer interface attachment point 16, the low functionality classification section 32L is attached to the classification section attachment point 17, the low functionality banknote storage boxes 35L are attached to the respective banknote storage attachment points 25, and nothing is attached to the temporary holding section attachment point 18.

For ease of explanation, in the following description, the high functionality customer interface 31H, the low functionality customer interface 31L, the high functionality classification section 32H, the low functionality classification section 32L, the high functionality banknote storage boxes 35H, and the low functionality banknote storage boxes 35L are respectively referred to as modules. Moreover, the high functionality customer interface 31H, the high functionality classification section 32H, and the high functionality banknote storage boxes 35H are also referred to as high functionality modules, and the low functionality customer interface 31L, the low functionality classification section 32L, and the low functionality banknote storage boxes 35L are also referred to as low functionality modules.

Moreover, in the banknote pay-in/pay-out device 10, the banknote controller 15 is capable of recognizing the respective module types attached to the respective sections of the banknote pay-in/pay-out device casing 11, for example whether the module attached to the customer interface attachment point 16 is the high functionality customer interface 31H or the low functionality customer interface 31L, and so on.

Specifically, the respective modules include non-volatile memory, with a different identification number stored for each type of module. When the respective modules are attached to the respective sections of the banknote pay-in/pay-out device casing 11, the banknote controller 15 is capable of recognizing the type of the respective module that have been attached by reading the identification numbers from the respective modules.

1-3. Deciding Operation Mode

Note that in the banknote pay-in/pay-out device 10, the types of transaction executable with a user differ according to the respective module types that are attached, for example, according to which the high functionality customer interface 31H or the low functionality customer interface 31L has been attached. Accordingly, immediately after the power supply is turned on, the banknote controller 15 of the banknote pay-in/pay-out device 10 decides an operation mode according to the type of the respective module that are attached, and limits the types of transaction that is capable according to the operation mode.

Figure 8:
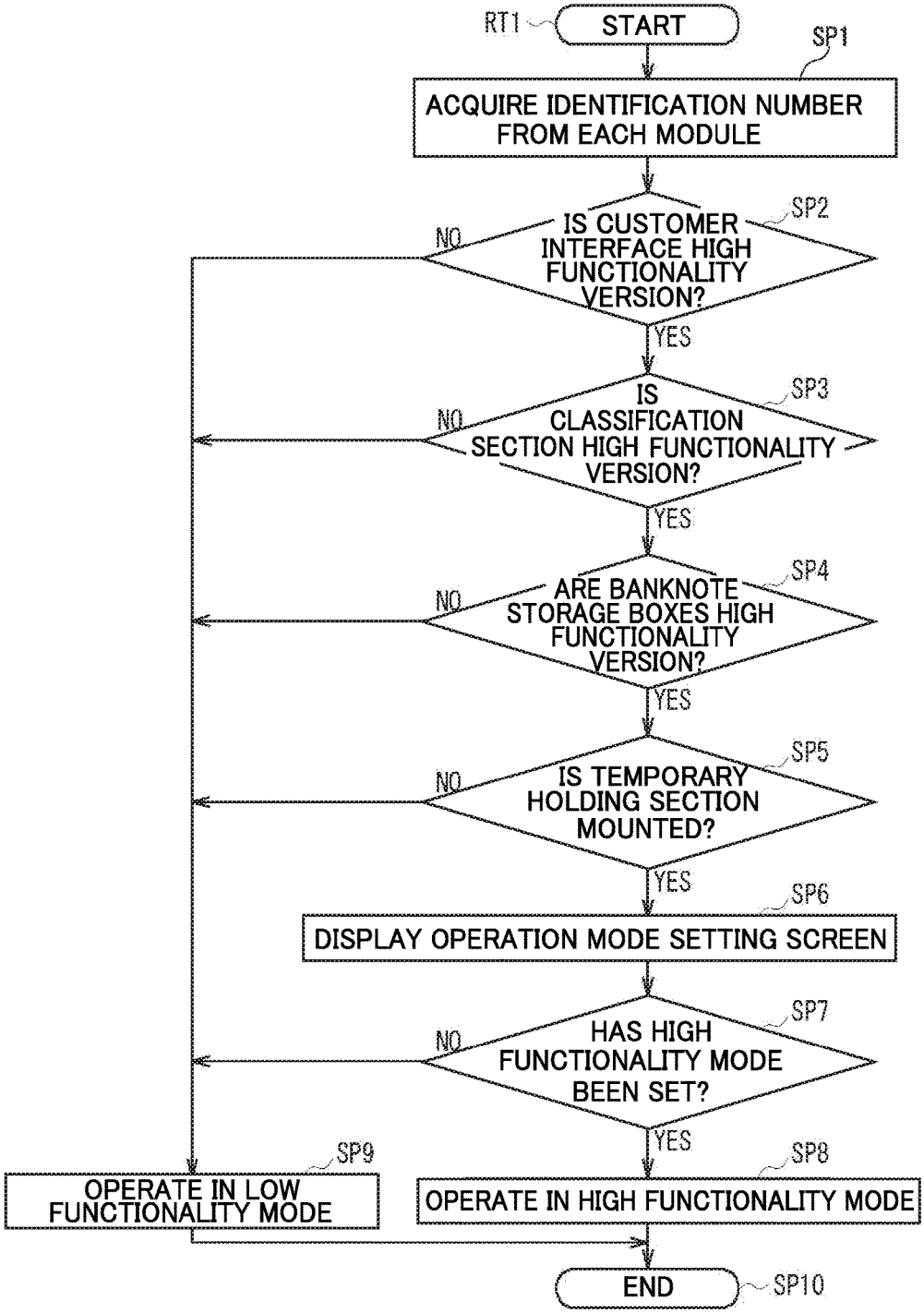
FIG. 8 is a schematic drawing illustrating an operation mode decision processing routine according to the first exemplary embodiment.

Specifically, after the power supply of the banknote pay-in/pay-out device 10 is turned on by a member of staff of the financial institution, a maintenance technician, or the like, the banknote controller 15 commences an operation mode decision processing routine RT1, illustrated in FIG. 8, and transitions to step SP1. At step SP1, the banknote controller 15 acquires the identification numbers from the respective modules, recognizes the type of the respective mounted modules, and transitions to the next step SP2.

Specifically, the banknote controller 15 recognizes whether the module attached to the customer interface attachment point 16 is the high functionality customer interface 31H or the low functionality customer interface 31L, and whether the module attached to the classification section attachment point 17 is the high functionality classification section 32H or the low functionality classification section 32L. The banknote controller 15 also recognizes whether the modules attached to the banknote storage attachment points 25 are the high functionality banknote storage boxes 35H or the low functionality banknote storage boxes 35L, and whether or not the temporary holding section 33 is attached to the temporary holding section attachment point 18.

At step SP2, the banknote controller 15 determines whether or not the high functionality customer interface 31H is attached to the customer interface attachment point 16. When the result is affirmative, the banknote controller 15 transitions to the next step SP3. At step SP3, the banknote controller 15 determines whether or not the high functionality classification section 32H is attached to the classification section attachment point 17. When the result is affirmative, the banknote controller 15 transitions to the next step SP4. At step SP4, the banknote controller 15 determines whether or not the high functionality banknote storage boxes 35H are attached to the banknote storage attachment points 25. When the result is affirmative, the banknote controller 15 transitions to the next step SP5.

At step SP5, the banknote controller 15 determines whether or not the temporary holding section 33 is attached to the temporary holding section attachment point 18. When the result if affirmative, this means that the banknote pay-in/pay-out device 10 is capable of performing pay-in transactions and the like in addition to performing pay-out transactions and the like, since the high functionality versions of the respective modules are mounted, and the temporary holding section 33 is also attached. In such cases, the banknote controller 15 transitions to the next step SP6.

Figure 9:
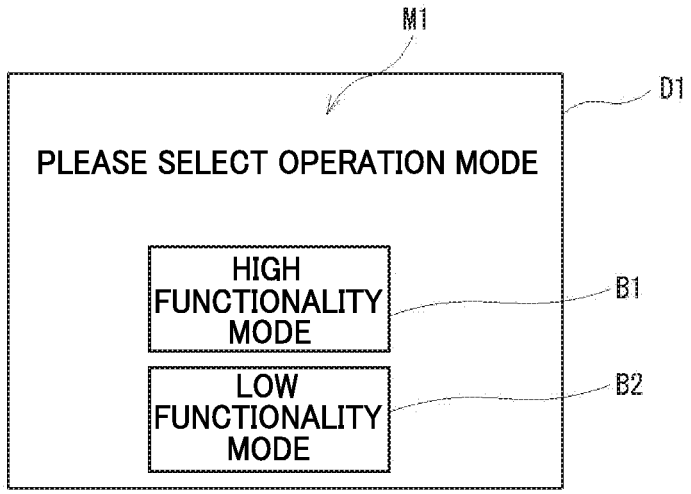
FIG. 9 is a schematic drawing illustrating configuration of an operation mode selection screen.

At step SP6, working together with the main controller 9 (FIG. 1), the banknote controller 15 displays an operation mode selection screen D1, illustrated in FIG. 9, on the operation and display section 6 (FIG. 1), and then transitions to the next step SP7. A message M1 and two buttons B1 and B2 configured by a Graphical User Interface (GUI) are displayed on the operation mode selection screen D1. The message M1 is displayed at an upper portion of the operation mode selection screen D1, and is a line of text reading "Please select operation mode", so as to prompt the maintenance technician or the like to press operate the two buttons B1 and B2. The buttons B1 and B2 respectively display "High functionality mode" and Low functionality mode", and the respective operation modes are selected by press operating the buttons B1 and B2.

At step SP7, working together with the main controller 9 (FIG. 1), the banknote controller 15 determines whether or not the button B1 of the operation mode selection screen D1 has been press operated. When the result is affirmative result, this means that pay-in transactions and the like should be carried out in addition to pay-out transactions and the like, according to the instruction from the maintenance technician or the like. In such cases, the banknote controller 15 transitions to the next step SP8.

At step SP8, the banknote controller 15 begins operation in the high functionality mode, and then transitions to the next step SP10 and ends the operation mode decision processing routine RT1. When this is performed, working together with the main controller 9 (FIG. 1), the banknote controller 15 displays a high functionality standby screen D2, illustrated in FIG. 10A, on the operation and display section 6 (FIG. 1) in a standby state awaiting the start of a transaction with a user.

A message M2 and five buttons B3, B4, B5, and B6 configured by a GUI are displayed on the high functionality standby screen D2. The message M2 is displayed at an upper portion of the high functionality standby screen D2, and is a line of text such as "Please select desired transaction", prompting a user to press operate the buttons B3 to B6. The buttons B3 to B6 display the respective transaction types "Pay-out", "Balance Enquiry", "Pay-in", and "Bank Transfer", and are press operated to select the respective transactions. When one of the buttons B3 to B6 is press operated, the banknote controller 15 starts respective processing according to the respective transaction.

When the result is negative at any of the steps SP2, SP3, SP4, or SP5, this means that the banknote pay-in/pay-out device 10 is not capable of operating in the high functionality mode, since a low functionality version module is attached to at least one of the customer interface attachment point 16, the classification section attachment point 17, or the banknote storage attachment points 25, or the temporary holding section 33 has not been attached. In such cases, the banknote controller 15 transitions to the next step SP9.

When the result is negative at step SP7, this means that even though the high functionality versions of the respective modules are attached, the temporary holding section 33 has also been attached, and the banknote pay-in/pay-out device 10 is in a state capable of operating in the high functionality mode, an instruction has actually been given to operate in the low functionality mode. In such cases, the banknote controller 15 transitions to the next step SP9.

At step SP9, the banknote controller 15 begins operation in the low functionality mode, and then transitions to the next step SP10 and ends the operation mode decision processing routine RT1. When this is performed, working together with the main controller 9 (FIG. 1), the banknote controller 15 displays a low functionality standby screen D3, illustrated in FIG. 10B, on the operation and display section 6 (FIG. 1) in a standby state awaiting the start of a transaction with a user. The low functionality standby screen D3 is configured such that the buttons B5 and B6 are omitted from the high functionality standby screen D2. Thus in the low functionality mode, the types of transaction that the banknote controller 15 may carry out are more limited than in the high functionality mode.

In this manner, by executing the operation mode decision processing routine RT1, the banknote controller 15 switches the operation mode of the banknote pay-in/pay-out device 10 between either the high functionality mode or the low functionality mode to change the transaction types that may be carried out.

The respective operation modes of the banknote pay-in/pay-out device 10, and the type of and whether or not the respective modules are attached, may be summarized as expressed in the operation mode table TBL1 illustrated in FIG. 11. Accordingly, setting of the operation mode may be regarded as being performed based on the operation mode table TBL1 by the banknote controller 15 executing the operation mode decision processing routine RT1.

1-4. Transaction Processing

Next, explanation follows regarding pay-in transactions and pay-out transactions in the banknote pay-in/pay-out device 10, as well as operation of the respective modules.

1-4-1. Pay-Out Transaction

First, explanation follows regarding a case in which a pay-out transaction is performed in a state in which the low functionality versions of the respective modules are attached to the banknote pay-in/pay-out device 10, and the temporary holding section 33 is not mounted, namely the state illustrated in FIG. 7.

When the button B3 on the low functionality standby screen D3 (FIG. 10B) is press operated by a user, the main controller 9 of the ATM 1 (FIG. 1) instructs the banknote controller 15 of the banknote pay-in/pay-out device 10 to start a pay-out transaction. In response, the banknote controller 15 of the banknote pay-in/pay-out device 10 reads and executes a stored pay-out program.

First, working together with the main controller 9 (FIG. 1), the banknote controller 15 prompts insertion of a cash card into the card insertion/removal port 4 (FIG. 1), and prompts entry of a PIN using the ten-key 7 or the like, thereby identifying the user's account number and the like. The banknote controller 15 also prompts the user to enter a pay-out amount using the operation and display section 6.

Next, the banknote controller 15 decides the denominations and number of banknotes corresponding to the pay-out amount, and then feeds out banknotes in these denominations and number from the low functionality banknote storage boxes 35L in sequence, conveys the banknotes to the low functionality classification section 32L using the lower conveyance section 21 and the front conveyance section 14A, and classifies the banknotes, as shown by the arrow W1 in FIG. 7.

When the banknote controller 15 has determined a banknote to have normal conveyance state based on the classification results obtained from the low functionality classification section 32L, as shown by the arrow W2, the banknote controller 15 conveys the banknote to the low functionality customer interface 31L using the rear conveyance section 14B, and the discharges and stacks the banknote in the receptacle 31A in sequence using the discharge section 31D. The receptacle 31A is in the separation and discharge state (FIG. 4B) when this is performed.

When the banknote controller 15 has determined that a banknote does not have a normal conveyance state, such as overlapping conveyance in which plural banknotes are conveyed overlapping each other, the banknote controller 15 determines this banknote to be a reject banknote that should not be paid out, and stores the reject banknote in the reject box 34 by what is referred to as a switchback operation.

Figure 12:
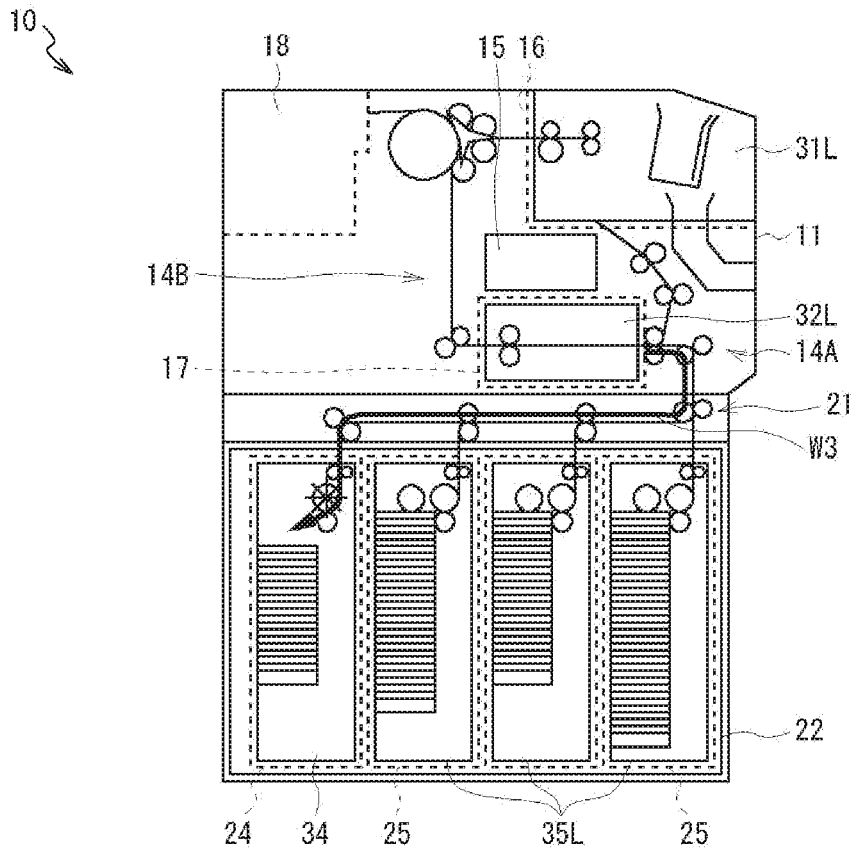
FIG. 12 is a schematic drawing illustrating the route taken by banknotes in a pay-out transaction in a low functionality mode according to the first exemplary embodiment.

Specifically, the banknote pay-in/pay-out device 10 halts banknote feed-out and conveyance from the low functionality banknote storage boxes 35L, and then, as shown by the arrow W3 in FIG. 12, reverses the conveyance direction of the lower conveyance section 21 and the front conveyance section 14A, thereby conveying all banknotes that have being conveyed to the reject box 34 to be stored. Then, the banknote pay-in/pay-out device 10 restarts the respective operations of banknote feed-out from the low functionality banknote storage boxes 35L, banknote conveyance using the lower conveyance section 21 and the front conveyance section 14A, and classification by the low functionality classification section 32L.

Finally, when the banknote pay-in/pay-out device 10 has finished conveying banknotes in the denominations and number of according to the pay-out amount to the low functionality customer interface 31L, the banknote pay-in/pay-out device 10 swings the receptacle 31A to the receiving/dispensing state (FIG. 4A) and opens the shutter 31B to allow the user to take out the banknotes. The banknote pay-in/pay-out device 10 then closes the shutter 31B of the low functionality customer interface 31L, and ends the pay-out transaction sequence.

1-4-2. Pay-In Transaction

Next, explanation follows regarding a case in which a pay-in transaction is performed in a state in which the high functionality versions of the respective modules are attached to the banknote pay-in/pay-out device 10, and the temporary holding section 33 is mounted, namely the state illustrated in FIG. 6.

When the button B6 on the high functionality standby screen D2 (FIG. 10A) is press operated by a user, the main controller 9 of the ATM 1 (FIG. 1) instructs the banknote controller 15 of the banknote pay-in/pay-out device 10 to start a pay-in transaction. In response, the banknote controller 15 of the banknote pay-in/pay-out device 10 reads and executes a stored pay-in program.

First, similarly to in the pay-out transaction, the banknote controller 15 prompts insertion of a cash card into the card insertion/removal port 4 (FIG. 1), and prompts entry of a PIN using the ten-key 7 or the like, thereby identifying the user's account number and the like. The banknote controller 15 places the receptacle 31A of the high functionality customer interface 31H in the receiving/dispensing state (FIG. 4A) and opens the shutter 31B to allow the user to insert banknotes into the receptacle 31A.

When banknotes have been inserted into the receptacle 31A, the high functionality customer interface 31H closes the shutter 31B and places the receptacle 31A in the separation and discharge state (FIG. 4B), and uses the separation section 31C to separate the banknotes and pass the banknotes across to the front conveyance section 14A in sequence, one note at a time.

As shown by the arrow W4 in FIG. 6, the front conveyance section 14A conveys banknotes to the high functionality classification section 32H. The high functionality classification section 32H classifies the conveyed banknotes in sequence, and supplies the obtained classification results to the banknote controller 15. The banknote controller 15 determines the conveyance state, denomination, authenticity, condition, and the like of the banknotes based on the classification results, and decides the conveyance destinations of the banknotes based on the determination results.

Specifically, when a banknote has a normal conveyance state and the denomination may be correctly identified, as shown by the arrow W5, the banknote controller 15 deems the banknote to be a pay-in acceptable banknote, and uses the rear conveyance section 14B to convey the banknote to the temporary holding section 33, and stores the banknote in sequence.

However, in cases in which a banknote cannot be determined to be normal, for example cases in which the conveyance state of the banknote is not normal due to being overlapping conveyance or the like, cases in which the denomination of a banknote cannot be identified, and the like, then the banknote controller 15 deems the banknote to be a pay-in reject banknote, and, as shown by the arrow W6, uses the rear conveyance section 14B to replace the banknote in the high functionality customer interface 31H. When a banknote replaced as a pay-in reject banknote is present, the high functionality customer interface 31H places the receptacle 31A in the receiving/dispensing state and opens the shutter 31B to return the banknote to the user, and prompts banknote reinsertion as required.

When the high functionality classification section 32H has completed classification of all of the banknotes inserted into the high functionality customer interface 31H, the banknote controller 15 adds up the total value (also referred to below as the pay-in amount) of the paid in banknotes, and while displaying a specific confirmation screen on the operation and display section 6 (FIG. 1), prompts the user to confirm the pay-in amount and instruct whether or not to continue with the pay-in transaction.

Figure 13:
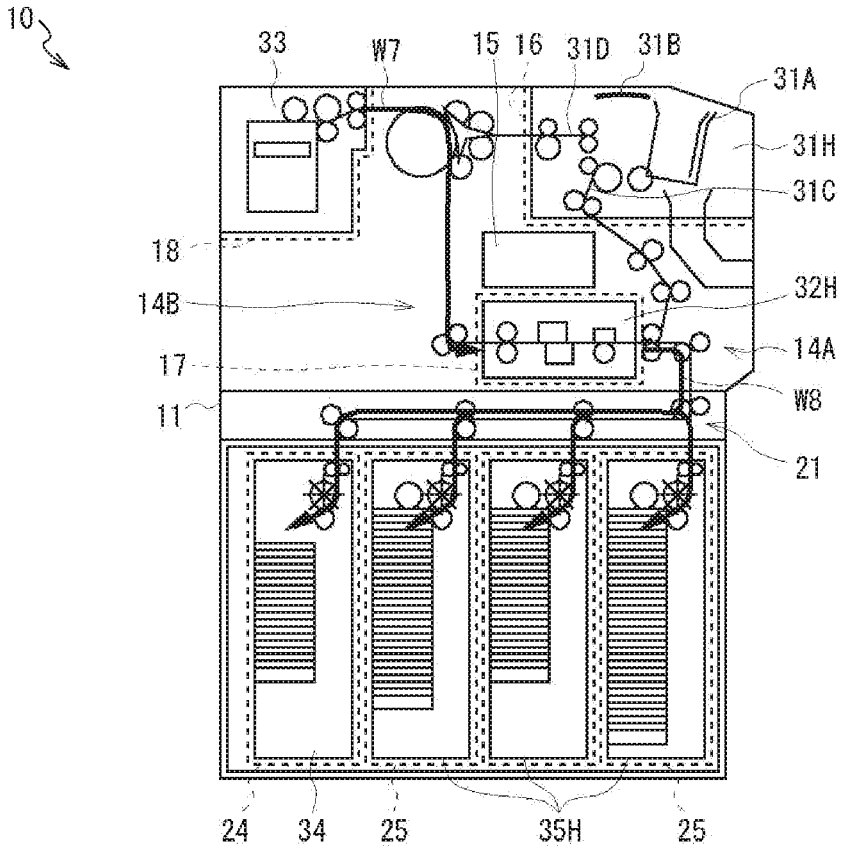
FIG. 13 is a schematic drawing illustrating the route taken by banknotes in a pay-in transaction in a high functionality mode according to the first exemplary embodiment.

When the user gives an instruction to continue with the pay-in transaction, the banknote controller 15 feeds out the banknotes stored in the temporary holding section 33 one note at a time to be conveyed to the high functionality classification section 32H by the rear conveyance section 14B, as shown by the arrow W7 illustrated in FIG. 13. The high functionality classification section 32H classifies the conveyed banknotes, and outputs the classification results to the banknote controller 15.

The banknote controller 15 decides the conveyance destinations of the banknotes based on the obtained classification results. Specifically, the banknote controller 15 deems banknotes that have a high degree of damage to be reject banknotes that are not suitable for re-use, and decides on the reject box 34 as the conveyance destination. The banknote controller 15 deems banknotes that have a low degree of damage to be re-usable banknotes, and decides on the high functionality banknote storage boxes 35H of the corresponding denominations as the conveyance destinations.

As shown by the arrow W8, the banknote controller 15 then controls the front conveyance section 14A and the lower conveyance section 21 so as to convey and store the respective banknotes, while sorting the respective banknotes according to their decided conveyance destinations.

When an instruction to abandon the pay-in transaction is given by the user at the confirmation screen, the banknote controller 15 conveys all of the banknotes stored in the temporary holding section 33 to the high functionality customer interface 31H using the rear conveyance section 14B, so as to return the banknotes to the user.

1-5. Operation and Advantageous Effects

In the banknote pay-in/pay-out device 10 according to the first exemplary embodiment configured as described above, the respective high functionality versions and low functionality versions of the modules (the customer interface 31, the classification section 32, and the banknote storage boxes 35) may be attached to the customer interface attachment point 16, the classification section attachment point 17, and the banknote storage attachment points 25. The banknote pay-in/pay-out device 10 may moreover be put into operation either in a state in which the temporary holding section 33 is attached to the temporary holding section attachment point 18, or in a state in which the temporary holding section 33 has been removed from the temporary holding section attachment point 18.

Moreover, the banknote controller 15 of the banknote pay-in/pay-out device 10 follows the operation mode decision processing routine RT1 (FIG. 8) to decide the operation mode according to the respective module types attached.

The banknote pay-in/pay-out device 10 is thereby capable of operating in the low functionality mode if the low functionality versions of the respective modules, namely the low functionality customer interface 31L, the low functionality classification section 32L, and the low functionality banknote storage boxes 35L are attached (FIG. 7). In such cases, the ATM 1 is capable of functioning as what is referred to as a cash dispenser that is capable of processing that does not involve pay-in by a user, specifically transaction processing such as pay-out transactions and balance enquiries.

Moreover, the banknote pay-in/pay-out device 10 is capable of operating in the high functionality mode if the high functionality versions of the respective modules, namely the high functionality customer interface 31H, the high functionality classification section 32H, and the high functionality banknote storage boxes 35H are attached, and the temporary holding section 33 is attached (FIG. 6). In such cases, the ATM 1 is capable of functioning as an ATM, capable of various transaction processing involving pay-in, such user pay-in transactions, in addition to the respective functions of a cash dispenser.

Note that the high functionality versions of the respective modules include more components than the low functionality versions of the various modules, and have more complex mechanisms, thereby entailing higher installation costs. Accordingly, for example, financial institutions are able to reduce installation costs by initially attaching the low functionality versions of the respective modules when the ATM 1 is newly installed. In such cases, the banknote pay-in/pay-out device 10 operates in the low functionality mode, enabling user pay-out transactions to be performed.

Later, the financial institution may wish to use the ATM 1 to perform transactions involving pay-in, such as pay-in transactions, according to the needs of the users and the like. In such cases, exchanging the low functionality versions of the respective modules for the high functionality versions of the respective modules, and attaching the temporary holding section 33, enables the banknote pay-in/pay-out device 10 to operate in the high functionality mode. When this is performed, the financial institution does not replace the entire ATM 1, but continues to employ the existing casing 2, operation and display section 6, banknote pay-in/pay-out device casing 11, banknote controller 15, and the like. It is sufficient that the high functionality versions of the respective modules and the temporary holding section 33 be newly installed.

Accordingly, the financial institution may reduce the cost of introducing new functions to a much cheaper level than in cases in which the entire ATM 1 is replaced. In other words, the banknote pay-in/pay-out device 10 enables what is referred to as upgrading, to increase the types of executable transactions, to be achieved by exchanging some of the modules.

In the banknote pay-in/pay-out device 10, the high functionality versions of the respective modules possess the functionality of the respective low functionality versions of the various modules, thereby maintaining what is referred to as upward compatibility. Accordingly, the banknote pay-in/pay-out device 10 is still capable of operating in the low functionality mode when only some of the high functionality versions of the modules are attached.

This thereby allows the financial institution to attach the high functionality versions of only some of the modules initially, for example in consideration of budgetary restraints and future module changeovers. In such cases, although the initial installation costs to the financial institution are greater than cases in which all of the modules are swapped from the low functionality versions to the high functionality versions together, the costs involved in swapping the modules, and the cumulative costs of the ATM 1 from the time of initial installation, may be kept low.

Moreover, for example, in a state in which the high functionality versions of the respective modules are attached to the banknote pay-in/pay-out device 10 (FIG. 6), when it is necessary to remove the temporary holding section 33 for maintenance, or when it is necessary to remove the high functionality versions of the modules for maintenance, and spare low functionality version modules are temporarily attached, the banknote pay-in/pay-out device 10 may operate in the low functionality mode. This enables the banknote pay-in/pay-out device 10 to perform some transaction processing, such as user pay-out transactions, without completely suspending operation, thereby enabling uptime of the device as a whole to be increased.

The banknote pay-in/pay-out device 10 displays the operation mode selection screen D1 (FIG. 9) at step SP6 of the operation mode decision processing routine RT1 (FIG. 8). This thereby enables low functionality mode operation even in a state in which the high functionality versions of the respective modules are attached and high functionality mode operation would be possible.

Accordingly, if, for example, faults occur in other coordinated systems in the financial institution, and it is desirable to perform pay-out transactions without performing pay-in transactions, the banknote pay-in/pay-out device 10 may easily be made to operate in the low functionality mode without performing operations to exchange or remove modules, or the like. Moreover, for example, after recovering from such faults, resetting the power supply or the like, and executing the operation mode decision processing routine RT1 again, enables the banknote pay-in/pay-out device 10 to easily be changed to the high functionality mode.

Moreover, what is referred to as switchback processing is performed when banknote conveyance abnormalities arise in the banknote pay-in/pay-out device 10 during pay-out processing performed in the low functionality mode. Accordingly, even though in the low functionality mode, a location capable of storing some of the banknotes segregated from other banknotes inside the upper section unit 12 (FIG. 2), namely the temporary holding section 33, is not present in the banknote pay-in/pay-out device 10, conveying the processing in which the abnormality has occurred to the reject box 34 enables storage in a state segregated from other, normal, banknotes.

According to the above configuration, in the banknote pay-in/pay-out device 10 according to the first exemplary embodiment, either the high functionality versions or the low functionality versions of the respective modules may be attached to the customer interface attachment point 16, the classification section attachment point 17, and the banknote storage attachment points 25, and the banknote pay-in/pay-out device 10 may be put into operation in either an attached state or a removed state of the of the temporary holding section 33 at the temporary holding section attachment point 18. Accordingly, if the low functionality versions of the respective modules are attached, the banknote pay-in/pay-out device 10 may function as a cash dispenser by operating in the low functionality mode, and may perform pay-out transaction processing that does not involve pay-in by the user. If the high functionality versions of the respective modules are attached, and the temporary holding section 33 is also attached, the banknote pay-in/pay-out device 10 may function as an ATM by operating in the high functionality mode, and is capable of performing transaction processing involving pay-in, such as user pay-in transactions, in addition to performing the respective functions of a cash dispenser.

2. Second Exemplary Embodiment

An ATM 101 (FIG. 1) according to a second exemplary embodiment differs from the ATM 1 according to the first exemplary embodiment in the point that it includes a banknote pay-in/pay-out device 110 in place of the banknote pay-in/pay-out device 10, but is configured similarly in other respects. The banknote pay-in/pay-out device 110 differs from the banknote pay-in/pay-out device 10 according to the first exemplary embodiment in the point that it includes a banknote controller 115 in place of the banknote controller 15, but is configured similarly in other respects.

Similarly to the banknote controller 15 in the first exemplary embodiment, the banknote controller 115 is mainly configured by a CPU, not illustrated in the drawings, and reads and executes specific programs from ROM, flash memory, and the like, not illustrated in the drawings, in order to control various processing relating to banknotes, such as banknote pay-in processing and pay-out processing.

The banknote controller 115 is capable of selecting a semi-low functionality mode in addition to the high functionality mode and the low functionality mode, these being similar to in the first exemplary embodiment, as operation modes of the banknote pay-in/pay-out device 110. The semi-low functionality mode is an operation mode that is similar to the low functionality mode overall, but is an operation mode in which the temporary holding section 33 is attached, and processing using the temporary holding section 33 is performed during pay-out processing (described in detail later).

Figure 14:
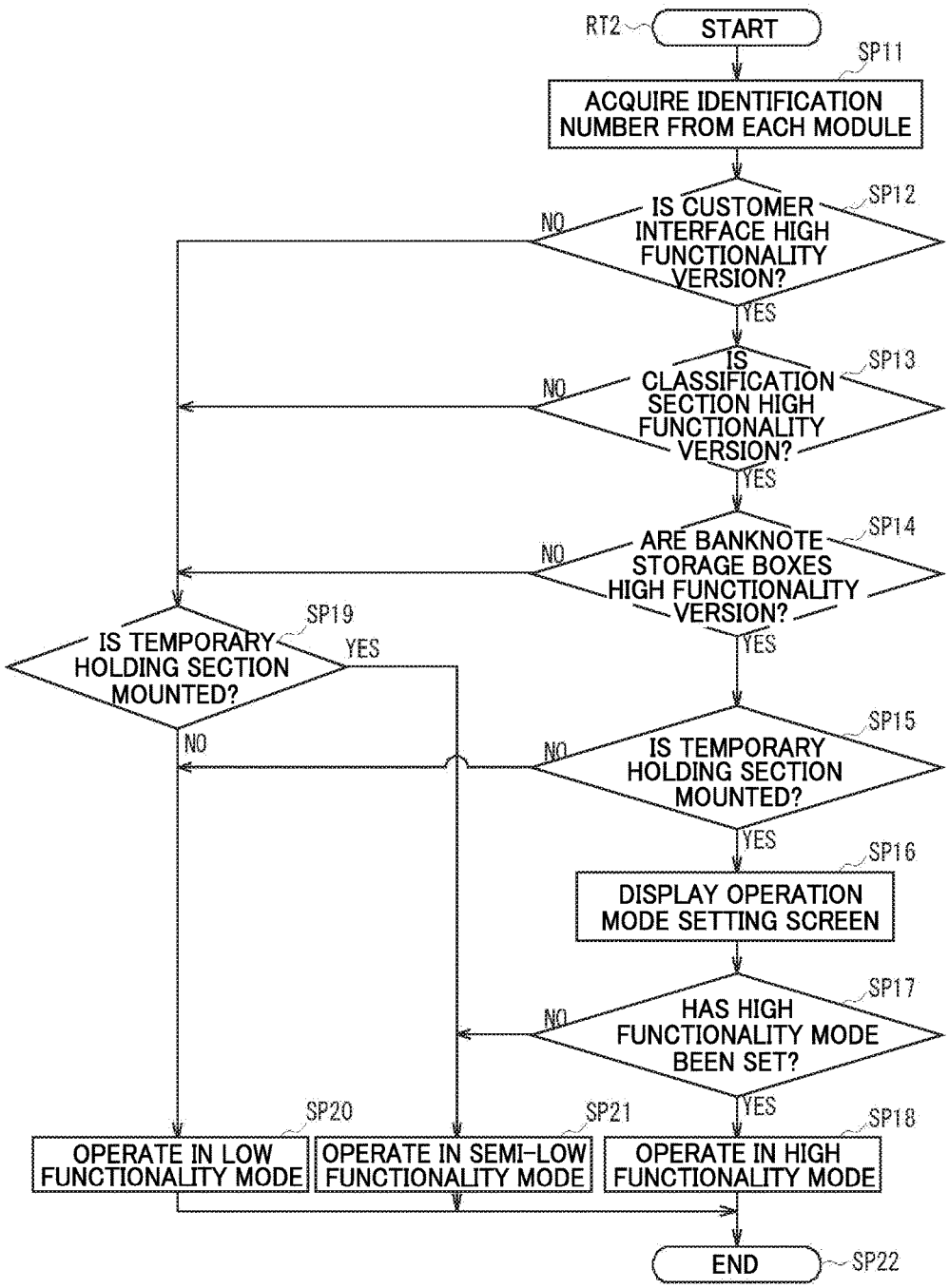
FIG. 14 is a schematic drawing illustrating an operation mode decision processing routine according to a second exemplary embodiment.

In order to decide the operation mode, the banknote controller 115 executes an operation mode decision processing routine RT2 according to the second exemplary embodiment, illustrated in FIG. 14, in place of the operation mode decision processing routine RT1 (FIG. 8) according to the first exemplary embodiment.

Specifically, when the power supply of the banknote pay-in/pay-out device 110 is turned on by a member of staff of the financial institution, a maintenance technician, or the like, the banknote controller 115 commences the operation mode decision processing routine RT2 (FIG. 14), and transitions to step SP11. At steps SP11 to SP18, the banknote controller 115 performs processing similar to that of steps SP1 to SP8 of the first exemplary embodiment so as to begin operation in the high functionality mode, and then transitions to the next step SP22 and ends the operation mode decision processing routine RT2.

However, when a negative result is obtained at step SP12, SP13, or SP14, the banknote controller 115 transitions to the next step SP19, and similarly to at step SP15, determines whether or not the temporary holding section 33 is attached to the temporary holding section attachment point 18.

When a negative result is obtained at step SP15 or SP19, this indicates that at least the temporary holding section 33 is not attached, and operation in the high functionality mode and the semi-low functionality mode is not possible. When this occurs, the banknote controller 115 transitions to the next step SP20 to commence operation in the low functionality mode, similarly to in the first exemplary embodiment, and then transitions to the next step SP22 and ends the operation mode decision processing routine RT2.

When an affirmative result is obtained at step SP19, this indicates that a low functionality version module is mounted to at least one location, and that the temporary holding section 33 is attached. The banknote controller 115 transitions to the next step SP21 when this occurs.

When a negative result is obtained at step SP17, that means that although the temporary holding section 33 is attached, operation should not be performed in the high functionality mode, in accordance with operation instructions of the maintenance technician or the like. The banknote controller 115 transitions to the next step SP21 when this occurs.

At step SP21, the banknote controller 115 commences operation in the semi-low functionality mode, transitions to the next step SP22, and ends the operation mode decision processing routine RT2. When this is performed, working together with the main controller 9 (FIG. 1), the banknote controller 115 displays the low functionality standby screen D3, illustrated in FIG. 10B, on the operation and display section 6 (FIG. 1) in a standby state awaiting the start of a transaction with a user. Namely, to the user, operation appears similar to that of the low functionality mode when the banknote pay-in/pay-out device 110 is operating in the semi-low functionality mode.

The respective operation modes of the banknote pay-in/pay-out device 110, and the type of and whether or not the respective modules are attached, may be summarized as expressed in the operation mode table TBL2 illustrated in FIG. 15, corresponding to FIG. 11.

Figure 16:
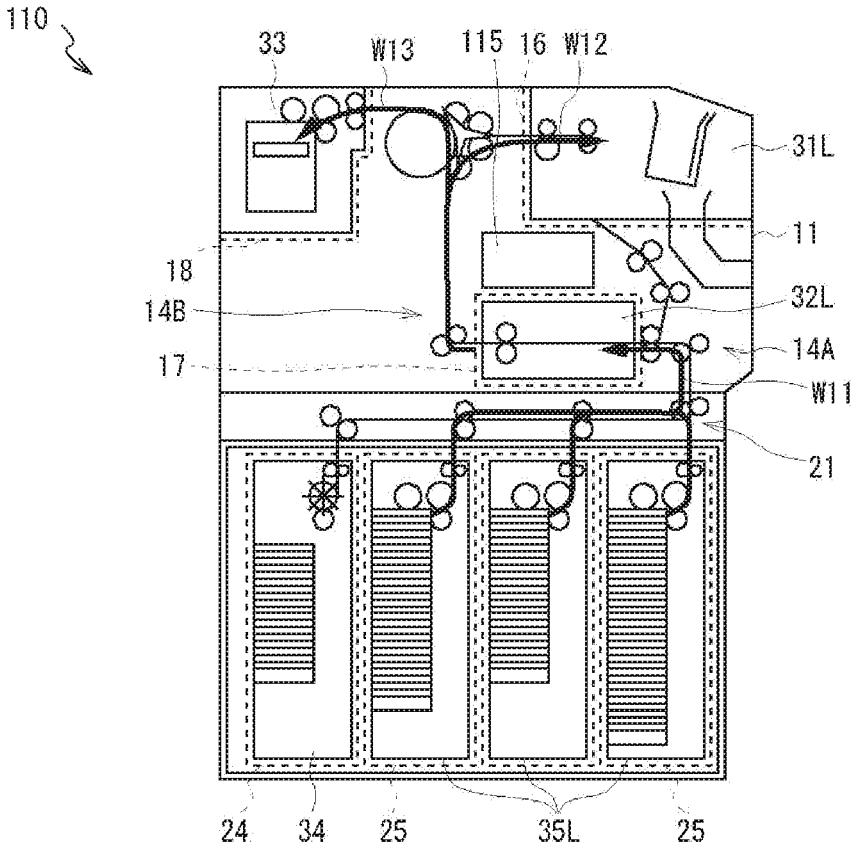
FIG. 16 is a schematic drawing illustrating the route taken by banknotes in a pay-out transaction in a semi-low functionality mode according to the second exemplary embodiment.

Next, explanation follows regarding a case in which the banknote pay-in/pay-out device 110 performs a pay-out transaction in the semi-low functionality mode. Note that as illustrated in FIG. 16, the low functionality versions of the respective modules are attached to the banknote pay-in/pay-out device 110; however, the temporary holding section 33 is mounted.

When banknotes are being conveyed normally, the banknote pay-in/pay-out device 110 operates similarly to in the first exemplary embodiment (FIG. 12). Namely, under the control of the banknote controller 115, the banknote pay-in/pay-out device 110 feeds out banknotes in sequence from the low functionality banknote storage boxes 35L in the denominations and number corresponding to the pay-out amount, and uses the lower conveyance section 21 and the front conveyance section 14A to convey the banknotes to be classified in the low functionality classification section 32L, as shown by the arrow W11. If the conveyance state of a banknote is normal, the banknote pay-in/pay-out device 110 uses the rear conveyance section 14B to convey the banknote to the low functionality customer interface 31L and stacks the banknote in the receptacle 31A, as shown by the arrow W12.

However, if the conveyance state of a banknote is abnormal, the banknote pay-in/pay-out device 110 determines the banknote to be a reject banknote, and uses the rear conveyance section 14B to convey the reject banknote to the temporary holding section 33 to be stored, as shown by the arrow W13. When this is performed, the banknote controller 115 switches a switching device provided to the rear conveyance section 14B at an appropriate timing, so as to convey only the reject banknote to the temporary holding section 33, while continuing to convey other, normal, banknotes to the low functionality customer interface 31L. In other words, the banknote pay-in/pay-out device 110 does not perform a switchback operation such as that of the first exemplary embodiment when a reject banknote has been detected.

Finally, when the banknote pay-in/pay-out device 110 has finished conveying the denominations and number of banknotes corresponding to the pay-out amount to the low functionality customer interface 31L, the banknote pay-in/pay-out device 110 swings the receptacle 31A to the receiving/dispensing state (FIG. 4A) and opens the shutter 31B to allow the user to take out the banknotes. The banknote pay-in/pay-out device 110 then closes the shutter 31B of the low functionality customer interface 31L.

Then, if there are reject banknotes stored in the temporary holding section 33, the banknote pay-in/pay-out device 110 uses the rear conveyance section 14B, the low functionality classification section 32L, the front conveyance section 14A, and the lower conveyance section 21 to convey the reject banknotes to the reject box 34 to be stored, as shown by the arrows W7 and W8 in FIG. 13.

In the low functionality mode and the high functionality mode, the banknote pay-in/pay-out device 110 also performs various transactions such as pay-out transactions and pay-in transactions according to the respective mode, similarly to in the first exemplary embodiment.

In the configuration described above, the banknote pay-in/pay-out device 110 according to the second exemplary embodiment operates in the semi-low functionality mode in cases in which one or more of the low functionality version modules are attached, and the temporary holding section 33 is attached to the temporary holding section attachment point 18, or in cases in which the low functionality mode has been selected at the operation mode selection screen (FIG. 9). In other words, the banknote pay-in/pay-out device 110 operates in the semi-low functionality mode in cases in which the temporary holding section 33 is attached and the banknote pay-in/pay-out device 110 does not operate in the high functionality mode.

In the semi-low functionality mode, when a conveyance state abnormality is detected, namely when a reject banknote arises, during a pay-out transaction, the banknote pay-in/pay-out device 110 switches the banknote conveyance path with the switching device provided to the rear conveyance section 14B, and conveys only the reject banknote to the temporary holding section 33 to be stored.

Accordingly, the banknote pay-in/pay-out device 110 is capable of greatly reducing the waiting time until banknotes of the pay-out amount are stacked in the receptacle 31A of the low functionality customer interface 31L and handed over to the user in comparison to in the first exemplary embodiment, in which the switchback operation is performed.

From another perspective, even if attached, the temporary holding section 33 is not used whatsoever in the low functionality mode in the first exemplary embodiment. By contrast, the second exemplary embodiment is provided with the semi-low functionality mode in which the temporary holding section 33 is actively utilized, which may result in a reduction in waiting time during transaction processing.

In other respects, the banknote pay-in/pay-out device 110 according to the second exemplary embodiment is capable of achieving similar operation and advantageous effects to the banknote pay-in/pay-out device 10 according to the first exemplary embodiment.

In the configuration described above, the banknote pay-in/pay-out device 110 according to the second exemplary embodiment operates in the semi-low functionality mode in cases in which it does not operate in the high functionality mode even though the temporary holding section 33 is attached. Accordingly, when the banknote pay-in/pay-out device 110 operates in the semi-low functionality mode, if a reject banknote arises during a pay-out transaction, the reject banknote is stored in the temporary holding section 33 while continuing to convey normal banknotes to the customer interface 31, without performing a switchback operation, thereby enabling the time taken to pay out banknotes to be greatly reduced.

3. Third Exemplary Embodiment

An ATM 201 (FIG. 1) according to a third exemplary embodiment differs from the ATM 1 according to the first exemplary embodiment in the point that it includes a banknote pay-in/pay-out device 210 in place of the banknote pay-in/pay-out device 10, but is configured similarly in other respects.

Figure 17:
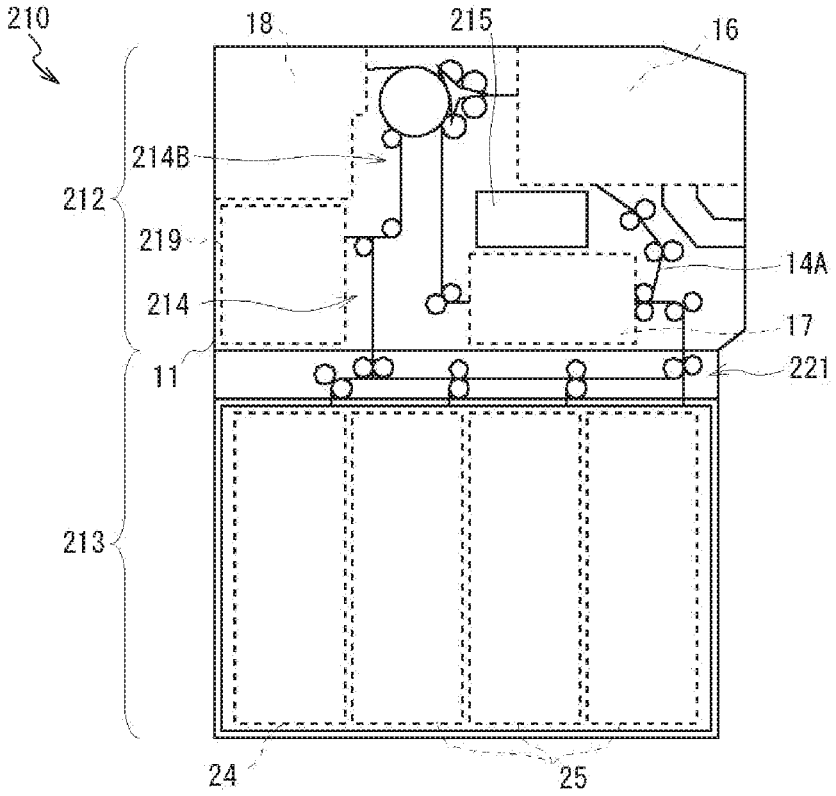
FIG. 17 is a schematic drawing illustrating configuration of a banknote pay-in/pay-out device according to a third exemplary embodiment.

As illustrated in FIG. 17 corresponding to FIG. 2, the banknote pay-in/pay-out device 210 is configured by an upper section unit 212 and a lower section unit 213 respectively corresponding to the upper section unit 12 and the lower section unit 13 of the first exemplary embodiment.

Of these, the upper section unit 212 differs from the upper section unit 12 according to the first exemplary embodiment in the point that it includes a rear conveyance section 214B and a banknote controller 215 in place of the rear conveyance section 14B and the banknote controller 15, and in the point that it includes a forgotten-banknote storage attachment point 219. The lower section unit 213 differs from the lower section unit 13 according to the first exemplary embodiment in the point that it includes a lower conveyance section 221 in place of the lower conveyance section 21.

Figure 18:
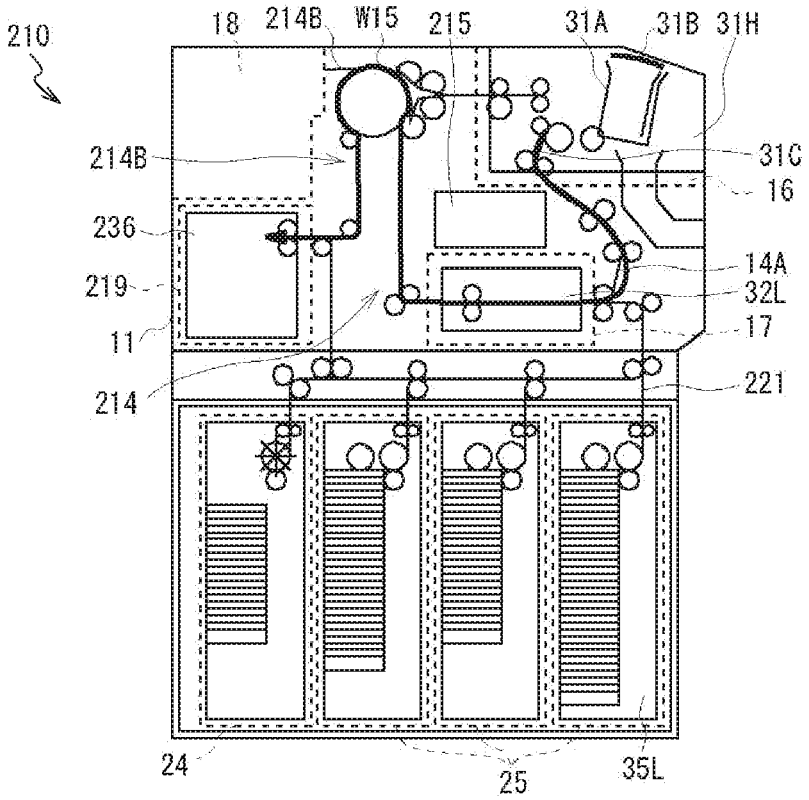
FIG. 18 is a schematic drawing illustrating the route taken by forgotten-banknotes in an attached state of a forgotten-banknote storage box according to the third exemplary embodiment.

As illustrated in FIG. 17, the forgotten-banknote storage attachment point 219 is provided inside the upper section unit 212, below the temporary holding section attachment point 18. Operation is possible in a state in which a forgotten-banknote storage box 236 is attached to the forgotten-banknote storage attachment point 219, as illustrated in FIG. 18, or in a state in which nothing is attached to the forgotten-banknote storage attachment point 219. The forgotten-banknote storage box 236 is capable of storing banknotes internally.

Note that when a pay-out transaction is performed between the ATM 201 and a user, sometimes the user may depart without taking out the banknotes paid out into the customer interface 31, namely, the banknotes may be forgotten. In such cases, it is necessary for the banknote pay-in/pay-out device 210 to segregate and look after the banknotes that have been forgotten (referred to below as forgotten-banknotes), without handing over the forgotten-banknotes to another user.

Accordingly, when the forgotten-banknote storage box 236 is attached to the banknote pay-in/pay-out device 210, the forgotten-banknote storage box 236 looks after the forgotten-banknotes in a state in which the forgotten-banknotes are isolated from other banknotes (described in detail later).

The rear conveyance section 214B differs from the rear conveyance section 14B according to the first exemplary embodiment in the point that a conveyance path connecting together the vicinity of the temporary holding section attachment point 18 and the vicinity of a rear end of the lower conveyance section 221 in the up-down direction, and a short conveyance path branching partway along this conveyance path and connected to the forgotten-banknote storage attachment point 219 along the front-rear direction, are additionally provided.

Similarly to the banknote controller 15 in the first exemplary embodiment, the banknote controller 215 is mainly configured by a CPU, not illustrated in the drawings, and reads and executes specific programs from ROM, flash memory, and the like, not illustrated in the drawings, in order to control various processing relating to banknotes, such as banknote pay-in processing and pay-out processing.

The banknote controller 215 selects either the high functionality mode or the low functionality mode as operation modes, similarly to the banknote controller 15 in the first exemplary embodiment. Moreover, the banknote controller 215 also sets a forgotten-banknote take-in flag to indicate that the forgotten-banknote storage box 236 may be used according to whether or not the forgotten-banknote storage box 236 has been attached to the forgotten-banknote storage attachment point 219. The forgotten-banknote take-in flag is OFF in an initial state.

Figure 19:
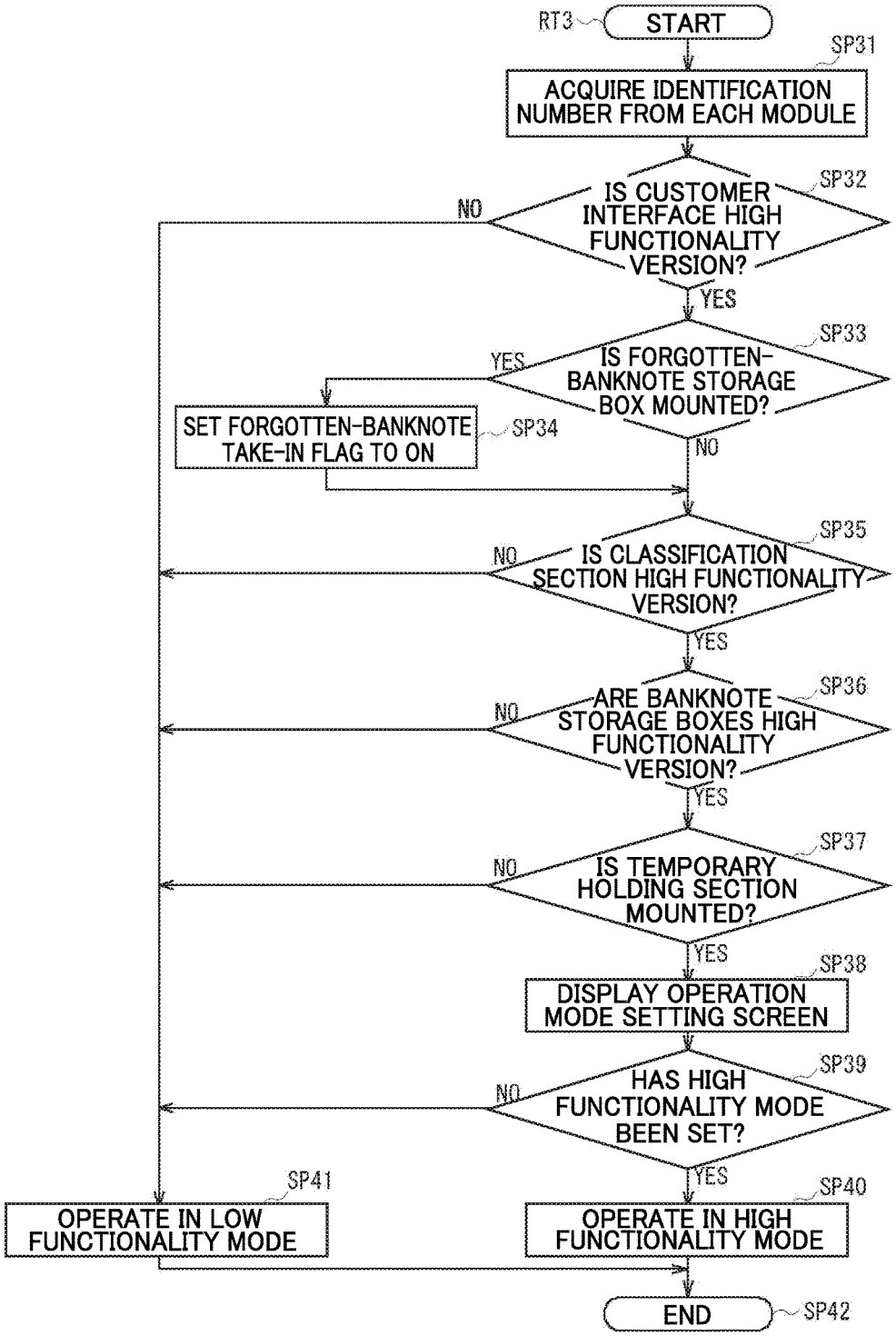
FIG. 19 is a schematic drawing illustrating an operation mode decision processing routine according to the third exemplary embodiment.

In order to decide the operation mode, the banknote controller 215 executes an operation mode decision processing routine RT3 according to the third exemplary embodiment, illustrated in FIG. 19, in place of the operation mode decision processing routine RT1 (FIG. 8) according to the first exemplary embodiment.

Specifically, when the power supply of the banknote pay-in/pay-out device 210 is turned on by a member of staff of the financial institution, a maintenance technician, or the like, the banknote controller 215 commences the operation mode decision processing routine RT3 (FIG. 19), and transitions to step SP31.

At steps SP31 and SP32, the banknote controller 215 performs similar processing to that of steps SP1 and SP2 of the first exemplary embodiment, and transitions to step SP33. At step SP33, the banknote controller 215 determines whether or not the forgotten-banknote storage box 236 is attached to the forgotten-banknote storage attachment point 219.

When an affirmative result is obtained, this indicates that the high functionality customer interface 31H and the forgotten-banknote storage box 236 have been attached, enabling forgotten-banknotes to be taken in and looked after in the forgotten-banknote storage box 236 when banknotes are forgotten. When this occurs, the banknote controller 215 transitions to the next step SP34 and sets the forgotten-banknote take-in flag to ON, and then transitions to the next step SP35.

When a negative result is obtained at step SP31, this indicates that when there are forgotten-banknotes, the forgotten-banknotes cannot be looked after in the forgotten-banknote storage box 236. When this occurs, the banknote controller 215 does not change the forgotten-banknote take-in flag, such that the forgotten-banknote take-in flag remains in the initial state of OFF, and transitions to the next step SP35.

Then, at steps SP35 to SP41, the banknote controller 215 performs similar processing to that of the respective steps SP3 to SP9 of the first exemplary embodiment (FIG. 8), begins operation in either the high functionality mode or the low functionality mode, and then transitions to the next step SP42 and ends the operation mode decision processing routine RT3.

The relationship between the setting state of the forgotten-banknote take-in flag (namely ON or OFF), the type of customer interface 31 attached to the customer interface attachment point 16, and the mounting/non-mounting of the forgotten-banknote storage box 236 to the forgotten-banknote storage attachment point 219, may be summarized as expressed in the forgotten-banknote take-in flag table TBL3, illustrated in FIG. 20.

The respective operation modes of the banknote pay-in/pay-out device 210, and the type of and whether or not the respective modules are attached, are expressed in the operation mode table TBL1 (FIG. 11), similarly to in the first exemplary embodiment.

Next, explanation follows regarding processing in cases in which forgotten-banknotes arise in a pay-out transaction of the ATM 201, for each setting state of the forgotten-banknote take-in flag.

Both the high functionality customer interface 31H and the low functionality customer interface 31L (namely the customer interface 31) illustrated in FIG. 4A and FIG. 4B are provided with sensors, not illustrated in the drawings, and are capable of detecting, for example, the presence or absence of banknotes in the receptacle 31A, and whether or not the hand of a user has approached the receptacle 31A, namely, whether or not banknotes have been taken out. The customer interface 31 notifies the banknote controller 215 of the detection results.

In cases in which, based on the detection results notified by the customer interface 31, the banknote controller 215 is notified that the banknotes have not been taken out even though a specific duration (for example 30 seconds) has elapsed since opening the shutter 31B in a pay-out transaction, the banknote controller 215 determines that the banknotes have been forgotten.

In cases in which the forgotten-banknote take-in flag is OFF, the low functionality customer interface 31L is attached, or the forgotten-banknote storage box 236 is not attached to the forgotten-banknote storage attachment point 219. Therefore, the banknote pay-in/pay-out device 210 is not able to convey the forgotten-banknotes to the forgotten-banknote storage box 236 to be stored.

Accordingly, when banknotes have been forgotten, the banknote pay-in/pay-out device 210 closes the shutter 31B of the low functionality customer interface 31L and stops accepting new transaction processing. Namely, the banknote pay-in/pay-out device 210 suspends operation with the banknotes still stored in the receptacle 31A of the low functionality customer interface 31L, so as to store the forgotten-banknotes inside the receptacle 31A.

In the banknote pay-in/pay-out device 210, in such cases, a member of staff of the financial institution, a maintenance technician, or the like performs a specific release operation using the operation and display section 6 or the like, and takes the forgotten-banknotes of the receptacle 31A, thereby enabling normal operation to be resumed.

However, in cases in which the forgotten-banknote take-in flag is ON, as illustrated in FIG. 18, the high functionality customer interface 31H and the forgotten-banknote storage box 236 are attached to the banknote pay-in/pay-out device 210, thereby enabling the banknotes inside the receptacle 31A to be taken in and stored in the forgotten-banknote storage box 236 in a state isolated from other banknotes.

Accordingly, when banknotes have been forgotten, after closing the shutter 31B of the high functionality customer interface 31H, the banknote pay-in/pay-out device 210 uses the separation section 31C to separate and take in the forgotten-banknotes one note at a time, and uses the front conveyance section 14A, the classification section 32, and the rear conveyance section 214B to convey the forgotten-banknotes in sequence to the forgotten-banknote storage box 236 to be stored, as shown by the arrow W15.

In such cases, the banknote pay-in/pay-out device 210 continues without suspending operation and displays the high functionality standby screen D2 or the low functionality standby screen D3 (FIG. 10) on the operation and display section 6 (FIG. 1) according to the current operation mode, so as to await an instruction by the next user to start the next transaction processing.

In the configuration described above, the banknote pay-in/pay-out device 210 according to the third exemplary embodiment sets the forgotten-banknote take-in flag to ON when the high functionality customer interface 31H is attached to the customer interface attachment point 16, and the forgotten-banknote storage box 236 is attached to the forgotten-banknote storage attachment point 219.

In cases in which the forgotten-banknote take-in flag is OFF, when the banknote pay-in/pay-out device 210 determines that a user has forgotten their banknotes, the banknote pay-in/pay-out device 210 closes the shutter 31B of the customer interface 31 to retain the forgotten-banknotes inside the receptacle 31A, stops accepting new transactions, and suspends operation.

In cases in which the forgotten-banknote take-in flag is ON, when the banknote pay-in/pay-out device 210 determines that a user has forgotten their banknotes, the banknote pay-in/pay-out device 210 uses the high functionality customer interface 31H to separate and take in the forgotten-banknotes in sequence one note at a time, to be conveyed to the forgotten-banknote storage box 236 and stored, and awaits the next transaction processing. Accordingly, in cases in which the forgotten-banknote take-in flag is ON, the banknote pay-in/pay-out device 210 is able to increase uptime by performing subsequent transactions, while reliably isolating the forgotten-banknotes from other banknotes.

From another perspective, in the first exemplary embodiment, the separation section 31C (FIG. 3A) is not used whatsoever in the low functionality mode, even if the high functionality customer interface 31H is attached to the customer interface attachment point 16. By contrast, in the third exemplary embodiment, if the forgotten-banknote take-in flag is ON, the separation section 31C of the high functionality customer interface 31H is actively utilized even when the operation mode is the low functionality mode, thereby enabling an improvement in uptime to be achieved.

In other respects, the banknote pay-in/pay-out device 210 according to the third exemplary embodiment is capable of achieving similar operation and advantageous effects to those the banknote pay-in/pay-out device 10 according to the first exemplary embodiment.

According to the above configuration, in the banknote pay-in/pay-out device 210 according to the third exemplary embodiment, the forgotten-banknote take-in flag is set to ON in cases in which the high functionality customer interface 31H and the forgotten-banknote storage box 236 are attached. Accordingly, when the banknote pay-in/pay-out device 210 determines that a user has forgotten their banknotes, the banknote pay-in/pay-out device 210 uses the high functionality customer interface 31H to separate and take in the forgotten-banknotes in sequence one note at a time, to be conveyed to the forgotten-banknote storage box 236 and stored. This thereby enables uptime to be improved, with no need to suspend operation, while looking after the forgotten-banknotes segregated from other banknotes.

4. Fourth Exemplary Embodiment

An ATM 301 (FIG. 1) according to a fourth exemplary embodiment differs from the ATM 1 according to the first exemplary embodiment in the point that it includes a banknote pay-in/pay-out device 310 in place of the banknote pay-in/pay-out device 10, but is configured similarly in other respects.

4-1. Banknote Pay-In/Pay-Out Device Configuration

Figure 21:
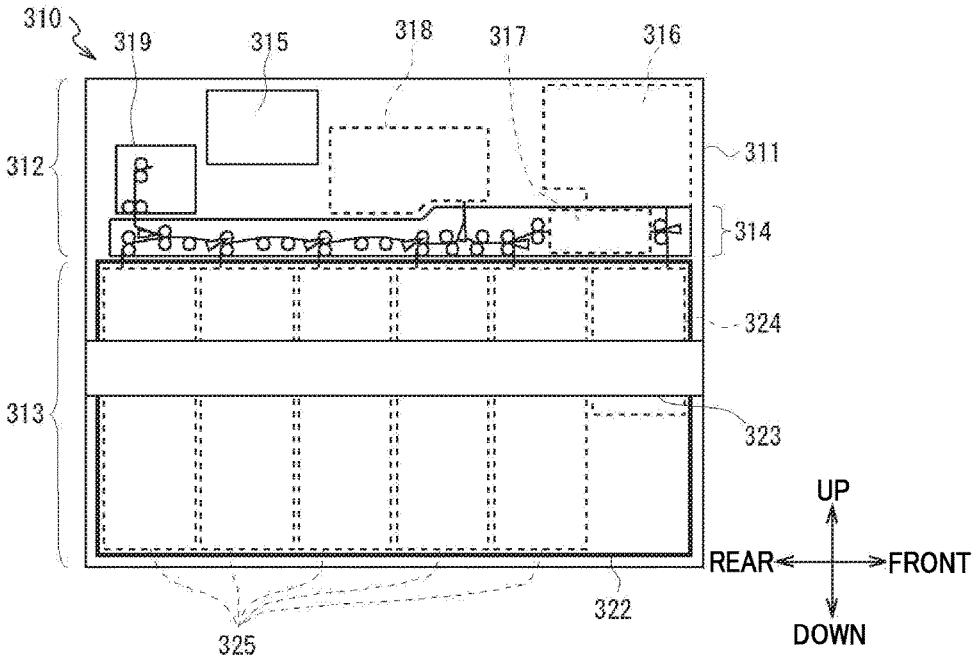
FIG. 21 is a schematic drawing illustrating configuration of a banknote pay-in/pay-out device according to a fourth exemplary embodiment.

As illustrated in FIG. 21 corresponding to FIG. 2, the banknote pay-in/pay-out device 310 is configured by a banknote pay-in/pay-out device casing 311, an upper section unit 312, and a lower section unit 313, respectively corresponding to the banknote pay-in/pay-out device casing 11, the upper section unit 12, and the lower section unit 13 according to the first exemplary embodiment.

The upper section unit 312 is configured by a conveyance section 314, a banknote controller 315, a customer interface attachment point 316, a classification section attachment point 317, and a temporary holding section attachment point 18, respectively corresponding to the upper conveyance section 14, the banknote controller 15, the customer interface attachment point 16, the classification section attachment point 17, and the temporary holding section attachment point 18 of the first exemplary embodiment, as well as a second reject box 319.

The conveyance section 314 differs greatly from the upper conveyance section 14 (FIG. 2) of the first exemplary embodiment, and forms a linear shaped conveyance path running primarily along the front-rear direction. As illustrated in the enlarged view of FIG. 22, the conveyance section 314 is disposed so as to surround the classification section attachment point 317 at the front and rear. A front conveyance section 314A is disposed at a front side of the classification section attachment point 317, and at a rear side of the classification section attachment point 317, an intermediate conveyance section 314B, a temporary holding conveyance section 314C, and a rear conveyance section 314D are disposed in this sequence on progression toward the rear.

In the conveyance section 314, respective conveyance paths branch off upward and downward from various locations on the conveyance path running in the front-rear direction. Switching devices that switch the direction of progress of banknotes are disposed at the respective branching locations on the conveyance path. The switching devices switch the direction of progress of the banknotes as appropriate, under the control of the banknote controller 315, described later.

Similarly to the banknote controller 15 of the first exemplary embodiment, the banknote controller 315 is mainly configured by a CPU, not illustrated in the drawings, and reads and executes specific programs from ROM, flash memory, and the like, not illustrated in the drawings, in order to control various processing relating to banknotes, such as banknote pay-in processing and pay-out processing.

Figure 23A:
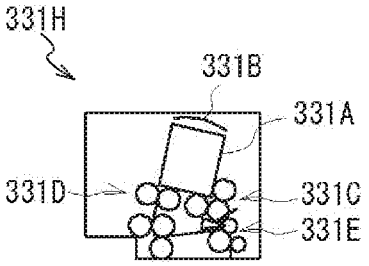
FIG. 23A is a schematic drawing illustrating configuration of a module according to the fourth exemplary embodiment.
Figure 23B:
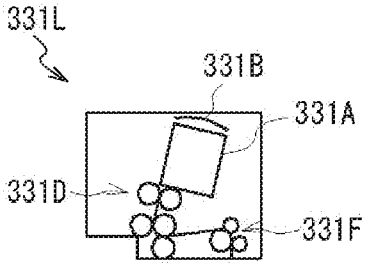
FIG. 23B is a schematic drawing illustrating configuration of a module according to the fourth exemplary embodiment.

The customer interface attachment point 316 resembles the customer interface attachment point 16 of the first exemplary embodiment, and is attached with either a high functionality customer interface 331H illustrated in FIG. 23A, corresponding to FIG. 3A, or a low functionality customer interface 331L illustrated in FIG. 23B, corresponding to FIG. 3B (both are also referred to collectively as the customer interface 331 below).

The high functionality customer interface 331H (FIG. 23A) has a configuration resembling that of the high functionality customer interface 31H of the first exemplary embodiment. Specifically, the high functionality customer interface 331H includes a receptacle 331A, a shutter 331B, a separation section 331C, and a discharge section 331D, respectively corresponding to the receptacle 31A, the shutter 31B, the separation section 31C, and the discharge section 31D. The receptacle 331A is fixed, and does not swing.

The high functionality customer interface 331H includes a customer interface conveyance section 331E that forms a banknote conveyance path and is incorporated with a switching device. The customer interface conveyance section 331E conveys banknotes after using the switching device to switch between a conveyance path linking between an acceptance port at a lower end of the customer interface conveyance section 331E and the separation section 331C, and a conveyance path linking between the acceptance port and the discharge section 331D.

The low functionality customer interface 331L (FIG. 23B) has a configuration such that the discharge section 331D omitted from the high functionality customer interface 331H, and with a customer interface conveyance section 331F in place of the customer interface conveyance section 331E. The customer interface conveyance section 331F does not include a switching section, and conveys banknotes along a conveyance path linking between an acceptance port at a lower end of the customer interface conveyance section 331F and the separation section 331C.

The classification section attachment point 317 (FIG. 21, FIG. 22) is attached with either the high functionality classification section 32H (FIG. 3C) or the low functionality classification section 32L (FIG. 3D), similarly to the classification section attachment point 17 of the first exemplary embodiment.

Figure 23C:
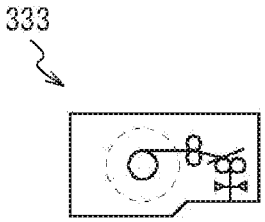
FIG. 23C is a schematic drawing illustrating configuration of a module according to the fourth exemplary embodiment.

The temporary holding section attachment point 318 resembles the temporary holding section attachment point 18 of the first exemplary embodiment, and is either attached with a temporary holding section 333, illustrated in FIG. 23C, corresponding to FIG. 3E, or is operated in a state in which nothing is attached. The temporary holding section 333 is what is referred to as a tape escrow type, and stores banknotes in sequence by wrapping the banknotes against a circumferential side face of a drum formed in a circular cylinder shape together with a tape while rotating the drum.

Similarly to the reject box 34 of the first exemplary embodiment, the second reject box 319 stores banknotes such as reject banknotes that should be looked after segregated from other banknotes.

The lower section unit 313 (FIG. 21) lacks the lower conveyance section 21 of the lower section unit 13 of the first exemplary embodiment (FIG. 2), and is provided with a slide unit 322 and slide rails 323 in place of the slide unit 22 and the slide rails 23 of the lower section unit 13. The slide unit 322 is provided with a reject box attachment point 324 provided at a frontmost side, and plural banknote storage attachment points 325 provided at the rear side of the reject box attachment point 324.

Figure 23D:
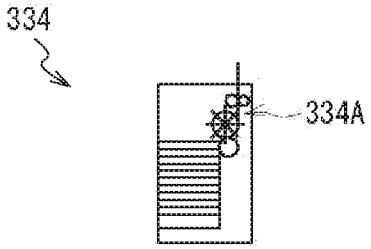
FIG. 23D is a schematic drawing illustrating configuration of a module according to the fourth exemplary embodiment.

A reject box 334, illustrated in FIG. 23D corresponding to FIG. 3F, is attached to the reject box attachment point 324. The reject box 334 includes a discharge mechanism 334A, similar to the discharge mechanism 34A of the first exemplary embodiment.

Figure 23E:
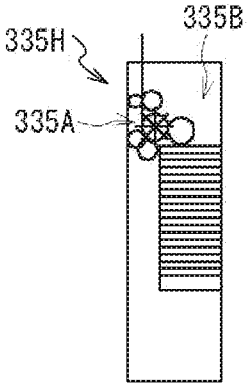
FIG. 23E is a schematic drawing illustrating configuration of a module according to the fourth exemplary embodiment.
Figure 23F:
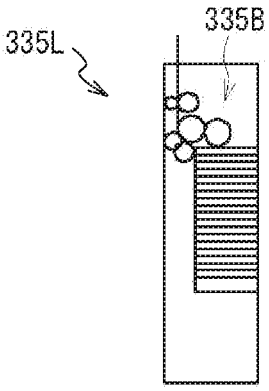
FIG. 23F is a schematic drawing illustrating configuration of a module according to the fourth exemplary embodiment.

Each of the banknote storage attachment points 325 is attached with either a high functionality banknote storage box 335H, illustrated in FIG. 23E corresponding to FIG. 3G, or a low functionality banknote storage box 335L, illustrated in FIG. 23F corresponding to FIG. 3H (both are also referred to collectively as banknote storage boxes 335 below).

Similarly to the high functionality banknote storage box 35H of the first exemplary embodiment, the high functionality banknote storage box 335H includes a discharge mechanism 335A and a separating mechanism 335B. Similarly to the low functionality banknote storage boxes 35L in the first exemplary embodiment, the low functionality banknote storage box 335L includes the separating mechanism 335B, but does not include the discharge mechanism 335A.

Figure 24:
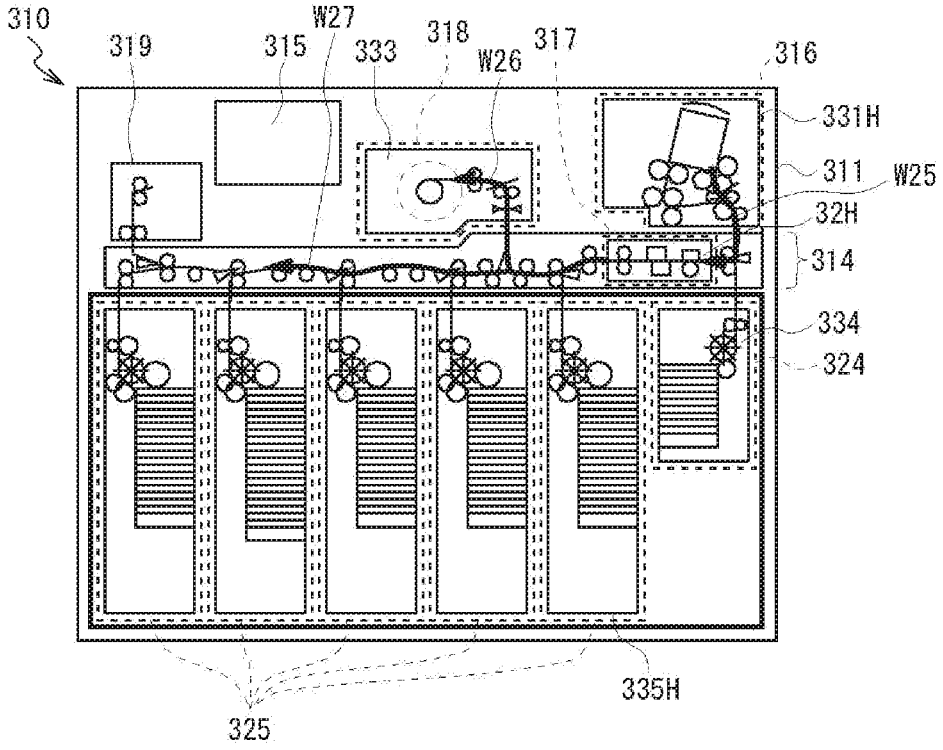
FIG. 24 is a schematic drawing illustrating configuration of a banknote pay-in/pay-out device attached with high functionality versions of respective modules according to the fourth exemplary embodiment, and illustrating the route taken by banknotes in a pay-in transaction in a high functionality mode.

In the banknote pay-in/pay-out device 310 configured in this manner, as illustrated in FIG. 24 corresponding to FIG. 6, for example, configuration may be made in which the high functionality customer interface 331H is attached to the customer interface attachment point 316, a high functionality classification section 332H is attached to the classification section attachment point 317, and the high functionality banknote storage boxes 335H are attached to the respective banknote storage attachment points 325. Moreover, the temporary holding section 333 may also be attached to the temporary holding section attachment point 318 of the banknote pay-in/pay-out device 310.

Figure 25:
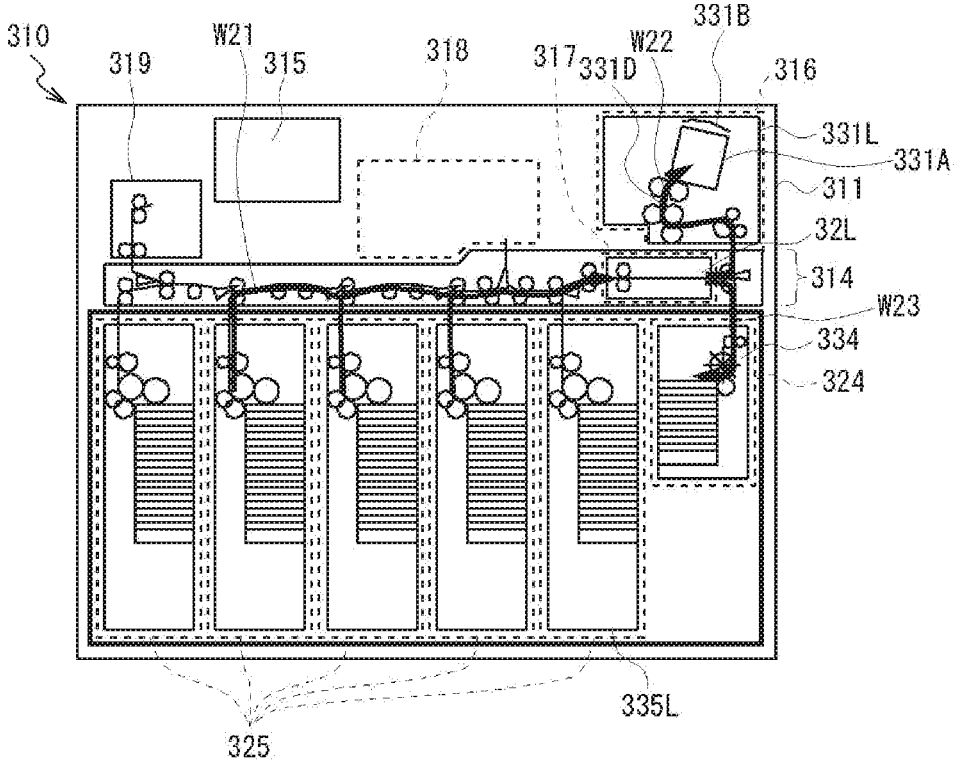
FIG. 25 is a schematic drawing illustrating configuration of a banknote pay-in/pay-out device attached with low functionality versions of respective modules according to the fourth exemplary embodiment, and illustrating the route taken by banknotes in a pay-out transaction in a low functionality mode.

Moreover, in the banknote pay-in/pay-out device 310, as illustrated in FIG. 25 corresponding to FIG. 7, for example, configuration may be made in which the low functionality customer interface 331L is attached to the customer interface attachment point 316, a low functionality classification section 332L is attached to the classification section attachment point 317, and the low functionality banknote storage boxes 335L are attached to the respective banknote storage attachment points 325. Moreover, nothing is attached to the temporary holding section attachment point 18 of the banknote pay-in/pay-out device 310.

4-2. Deciding Operation Mode

Note that as operation modes of the banknote pay-in/pay-out device 310, the banknote controller 315 is capable of selecting a semi-high functionality mode, in addition to a high functionality mode and a low functionality mode similar to those of the first exemplary embodiment. The semi-high functionality mode is an operation mode resembling the high functionality mode overall, but is an operation mode for cases in which the temporary holding section 33 is not attached, and performs processing that does not employ the temporary holding section 33 during pay-in transactions.

Figure 26:
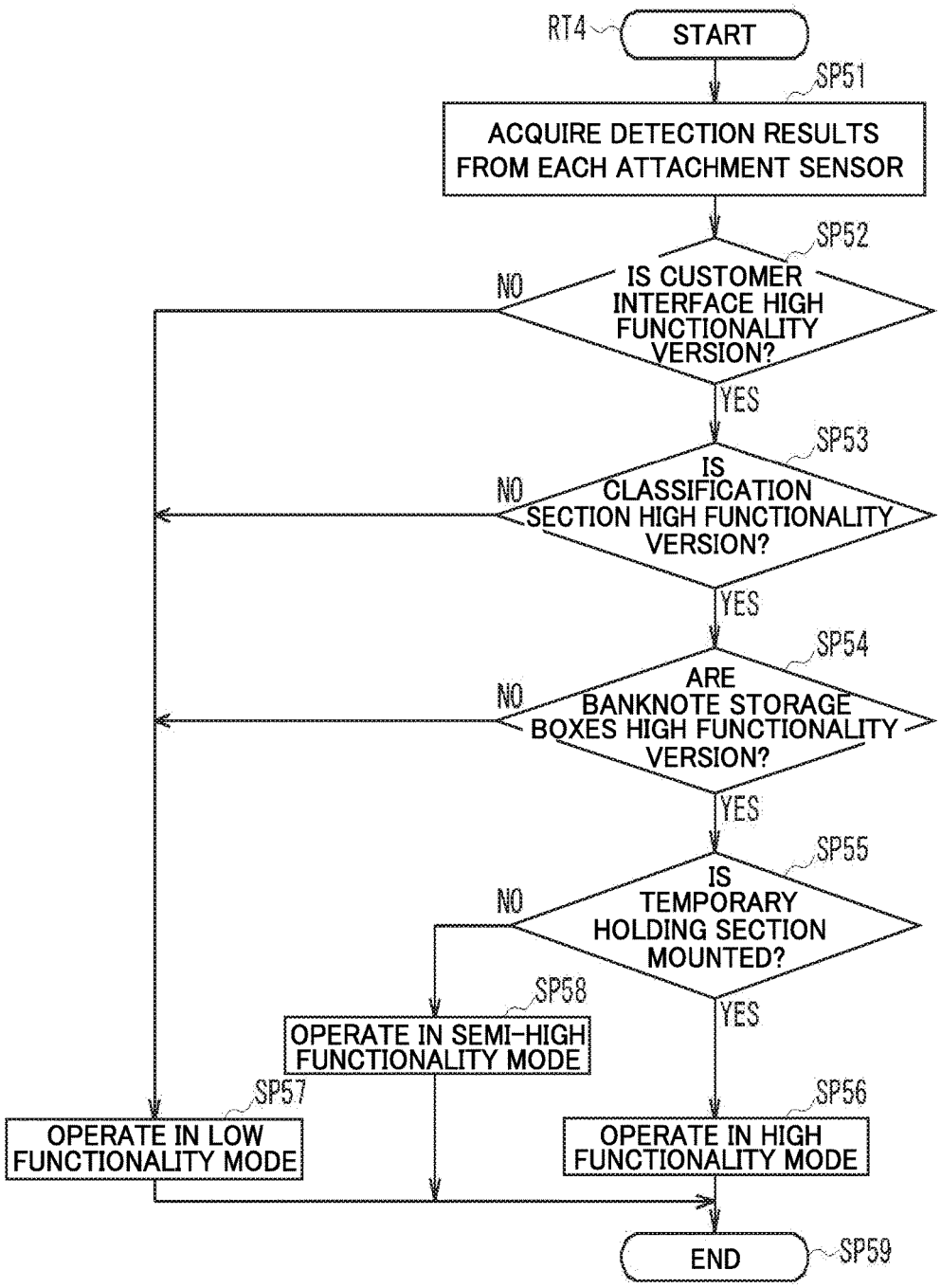
FIG. 26 is a schematic drawing illustrating an operation mode decision processing routine according to the fourth exemplary embodiment.

In order to decide the operation mode, the banknote controller 115 executes an operation mode decision processing routine RT4 according to the fourth exemplary embodiment, illustrated in FIG. 26, in place of the operation mode decision processing routine RT1 (FIG. 8) according to the first exemplary embodiment.

Specifically, when the power supply of the banknote pay-in/pay-out device 310 is turned on by a member of staff of the financial institution, a maintenance technician, or the like, the banknote controller 315 commences the operation mode decision processing routine RT4 (FIG. 26), and transitions to step SP51. At steps SP51 to SP56, the banknote controller 315 performs similar processing to that of steps SP1 to SP5, and step SP8 of the first exemplary embodiment so as to begin operation in the high functionality mode, and then transitions to the next step SP59 and ends the operation mode decision processing routine RT4.

When a negative result is obtained at step SP52, SP53, or SP54, this means that operation in the high functionality mode is not possible. In such cases, the banknote controller 315 transitions to the next step SP57, thereby beginning operation in the low functionality mode, similarly to in the first exemplary embodiment, and then transitions to the next step SP59 and ends the operation mode decision processing routine RT4.

When a negative result is obtained at step SP55, this means that the high functionality customer interface 331H, the high functionality classification section 332H, and the high functionality banknote storage box 335H are attached, but the temporary holding section 333 is not attached, and so it is not possible to operate in the high functionality mode. In such cases, the banknote controller 315 transitions to the next step SP58, thereby beginning operation in the semi-high functionality mode, and then transitions to the next step SP59 and ends the operation mode decision processing routine RT4.

Figure 10A:
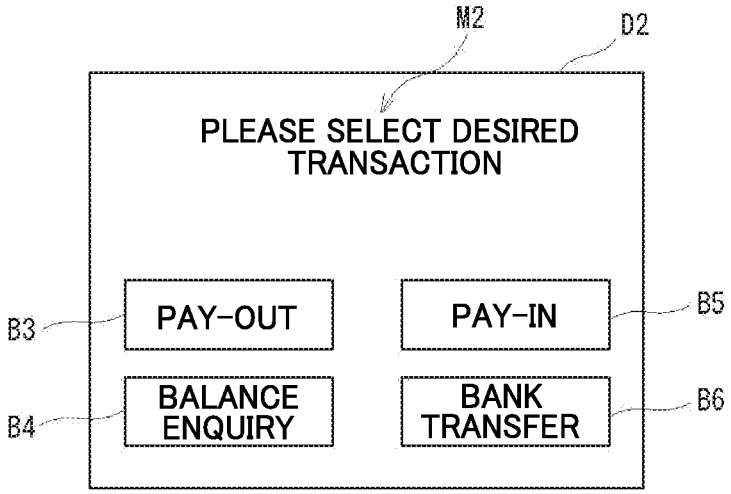
FIG. 10A is a schematic drawing illustrating configuration of a standby screen.
Figure 10B:
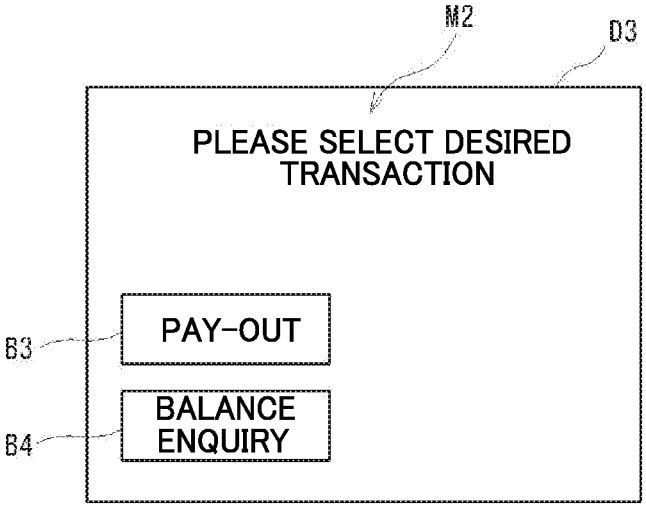
FIG. 10B is a schematic drawing illustrating configuration of a standby screen.

Working together with the main controller 9 (FIG. 1), the banknote controller 315 displays the high functionality standby screen D2 illustrated in FIG. 10A on the operation and display section 6 (FIG. 1) in a standby state awaiting the start of a transaction with a user. Namely, to the user, operation appears similar to that of the high functionality mode when the banknote pay-in/pay-out device 310 is operating in the semi-high functionality mode.

The respective operation modes of the banknote pay-in/pay-out device 310, and the type of and whether or not the respective modules are attached, may be summarized as expressed in the operation mode table TBL4 illustrated in FIG. 27 corresponding to FIG. 11 and FIG. 15.

4-3. Transaction Processing

Next, explanation follows regarding pay-in transactions and pay-out transactions of the banknote pay-in/pay-out device 310, as well as operation of the respective modules.

4-3-1. Pay-Out Transaction

First, explanation follows regarding a case in which a pay-out transaction is performed in a state in which the low functionality versions of the respective modules are attached to the banknote pay-in/pay-out device 310, and the temporary holding section 333 is not mounted, namely a state in which the banknote pay-in/pay-out device 310 is operating in the low functionality mode, as illustrated in FIG. 25.

First, similarly to in the first exemplary embodiment, working together with the main controller 9 (FIG. 1), the banknote controller 315 of the banknote pay-in/pay-out device 310 prompts the user to input a pay-out amount using the operation and display section 6.

Next, the banknote controller 315 decides the denominations and numbers of banknotes corresponding to the pay-out amount, and then feeds out banknotes in these denominations and number of banknotes from the low functionality banknote storage boxes 335L in sequence, conveys the banknotes to the low functionality classification section 32L using the rear conveyance section 314D, the temporary holding conveyance section 314C, and the intermediate conveyance section 314B of the conveyance section 314, and classifies the banknotes, as shown by the arrow W21 in FIG. 25.

When the banknote controller 315 has determined a banknote to have a normal conveyance state based on the classification results obtained from the low functionality classification section 32L, as shown by the arrow W22, the banknote controller 315 conveys the banknote to the low functionality customer interface 331L using the front conveyance section 314A, and discharges and stacks the banknote in the receptacle 331A in sequence using the discharge section 331D.

Figure 22:
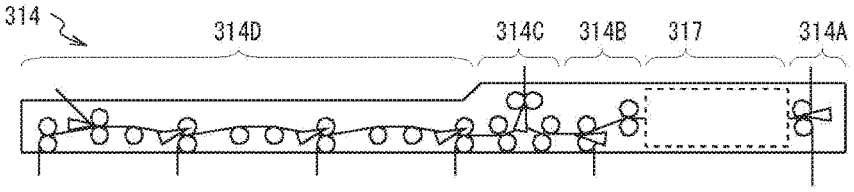
FIG. 22 is a schematic drawing illustrating configuration of a conveyance section according to the fourth exemplary embodiment.

When the banknote controller 315 has determined a banknote not to have a normal conveyance state, such as overlapping conveyance which plural banknotes are conveyed overlapping each other, the banknote controller 315 determines this banknote to be a reject banknote that should not be paid out, and as shown by the arrow W23, conveys the reject banknote to the reject box 334 to be stored using the front conveyance section 314A (FIG. 22).

Finally, when the banknote pay-in/pay-out device 310 has finished conveying the denominations and number of banknotes corresponding to the pay-out amount to the low functionality customer interface 331L, the banknote pay-in/pay-out device 310 opens the shutter 331B to allow the user to take out the banknotes. The banknote pay-in/pay-out device 310 then closes the shutter 331B of the low functionality customer interface 331L, and ends the pay-out transaction sequence.

Note that when paid out banknotes are forgotten in a state in which the banknote pay-in/pay-out device 310 is operating in the low functionality mode, similarly to in the third exemplary embodiment, the banknote pay-in/pay-out device 310 suspends operation with the banknotes still stored in the receptacle 31A of the low functionality customer interface 31L of the low functionality customer interface 31L, so as to store the forgotten-banknotes in the receptacle 31A.

Figure 28:
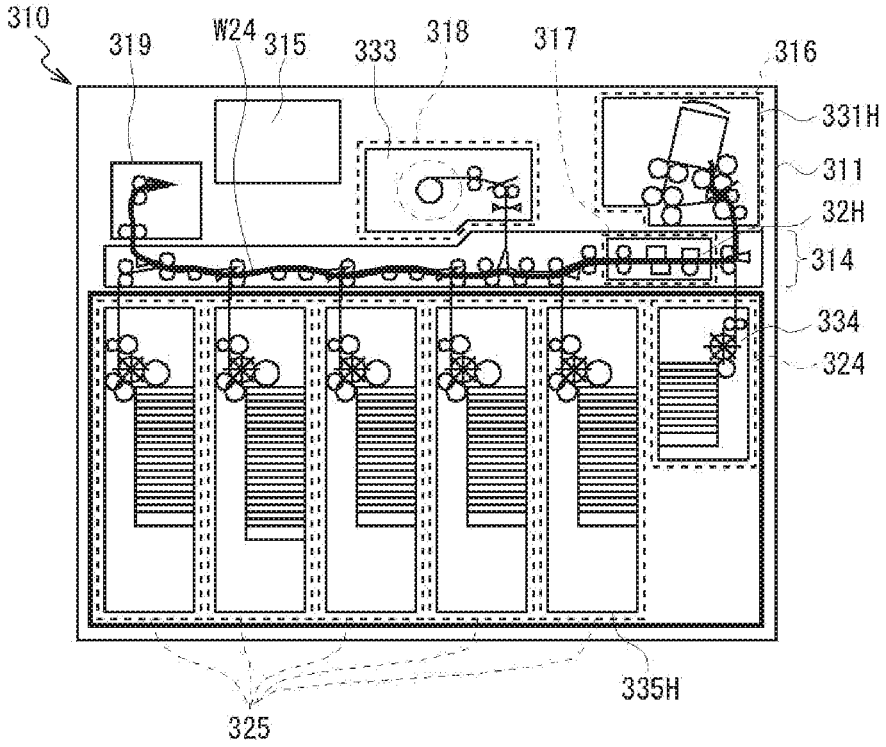
FIG. 28 is a schematic drawing illustrating the route taken by forgotten-banknotes in a pay-out transaction in a high functionality mode according to the fourth exemplary embodiment.

However, when paid out banknotes are forgotten in a state in which the banknote pay-in/pay-out device 310 is operating in the high functionality mode, as illustrated in FIG. 28, after closing the shutter 331B of the high functionality customer interface 331H, the banknote pay-in/pay-out device 310 uses the separation section 331C to separate and take in the forgotten-banknotes one note at a time, and, as shown by the arrow W24, uses the conveyance section 314 to convey the forgotten-banknotes in sequence to the second reject box 319 to be stored.

4-3-2. Pay-In Transaction in High Functionality Mode

Next, explanation follows regarding a case in which a pay-in transaction is performed in a state in which the high functionality versions of the respective modules are attached to the banknote pay-in/pay-out device 310, and the temporary holding section 33 is mounted, namely in a state in which the banknote pay-in/pay-out device 310 is operating in the high functionality mode, as illustrated in FIG. 24.

First, similarly to in the first exemplary embodiment, working together with the main controller 9 (FIG. 1), the banknote controller 315 of the banknote pay-in/pay-out device 310 receives a pay-in transaction instruction from a user using the operation and display section 6. The banknote controller 315 opens the shutter 331B of the high functionality customer interface 331H to allow the user to insert banknotes into the receptacle 331A.

When banknotes have been inserted into the receptacle 331A, the high functionality customer interface 331H closes the shutter 331B, and uses the separation section 331C (FIG. 23A) to separate and pass the banknotes across to the front conveyance section 314A in sequence one note at a time.

The front conveyance section 314A conveys the banknotes to the high functionality classification section 32H, as shown by the arrow W25 in FIG. 24. The high functionality classification section 32H classifies the conveyed banknotes in sequence and supplies the banknote controller 315 with classification results. The banknote controller 315 determines the conveyance state, denomination, authenticity, condition, and the like of the banknotes based on the obtained classification results, and decides the conveyance destinations of the banknotes based on the determination results.

Specifically, when a banknote has a normal conveyance state and the denomination is correctly identified, the banknote controller 315 deems the banknote to be a pay-in acceptable banknote, and, as shown by the arrow W26, uses the intermediate conveyance section 314B (FIG. 22) and the temporary holding conveyance section 314C to convey the banknote to the temporary holding section 333 to be stored in sequence. The banknote controller 315 also stores a banknote denomination, condition, and the like associated with the position in sequence of the banknote.

However, in cases in which a banknote cannot be determined to be normal, for example cases in which the conveyance state of the banknote is not normal due to being overlapping conveyance or the like, cases in which the denomination of a banknote cannot be identified, and the like, the banknote the banknote controller 315 deems the banknote to be a pay-in reject banknote and conveys the banknote to the rear conveyance section 314D (FIG. 22) as shown by the arrow W27, and halts and stores the banknote on the conveyance path inside the rear conveyance section 314D.

At the point when the high functionality classification section 32H has completed classification of all of the banknotes inserted into the high functionality customer interface 331H, if there are pay-in reject banknotes stored in the rear conveyance section 314D, the banknote controller 315 conveys the pay-in reject banknotes to the high functionality customer interface 331H, and opens the shutter 31B to return the pay-in reject banknotes to the user.

If there are no pay-in reject banknotes stored in the rear conveyance section 314D, the banknote controller 315 adds up the total value (also referred to below as the pay-in amount) of the paid in banknotes, and while displaying a specific confirmation screen on the operation and display section 6 (FIG. 1), prompts the user to confirm the pay-in amount and instruct whether or not to continue with the pay-in transaction.

Figure 29:
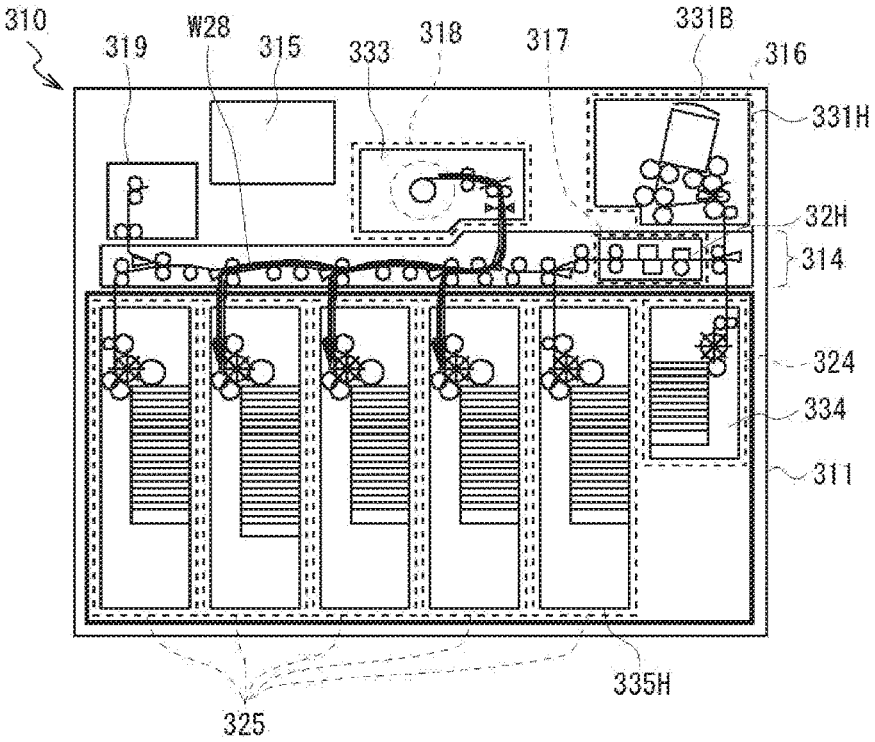
FIG. 29 is a schematic drawing illustrating the route taken by banknotes in a pay-in transaction in a high functionality mode according to the fourth exemplary embodiment.

When the user gives an instruction to continue with the pay-in transaction, the banknote controller 315 feeds out the banknotes stored in the temporary holding section 33 one note at a time, as shown by the arrow W28 illustrated in FIG. 29, and decides the conveyance destinations based on the stored classification results. Specifically, the banknote controller 315 decides the reject box 334 as the conveyance destination of reject banknotes, and decides the high functionality banknote storage boxes 335H of the respective denominations as the conveyance destinations for re-usable banknotes. The banknote controller 315 then controls the respective switching devices of the conveyance section 314 as appropriate so as to convey and store the respective banknotes, while sorting the respective banknotes by their decided conveyance destinations.

When an instruction to abandon the pay-in transaction is given by the user at the confirmation screen, the banknote controller 315 conveys all of the banknotes stored in the temporary holding section 333 to the high functionality customer interface 331H and opens the shutter 331B so as to return the banknotes to the user. In such cases, the banknote pay-in/pay-out device 310 is capable of returning the paid in banknotes straightaway to the user, without exchanging them for other banknotes.

4-3-3. Pay-In Transaction in Semi-High Functionality Mode

Figure 30:
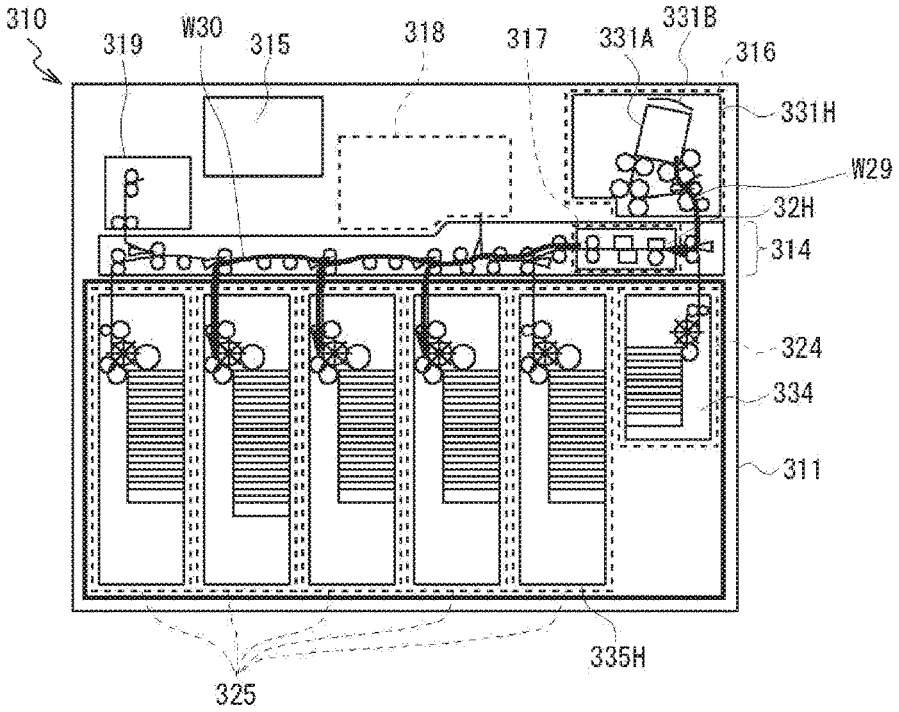
FIG. 30 is a schematic drawing illustrating the route taken by banknotes in a pay-in transaction in a semi-high functionality mode according to the fourth exemplary embodiment.

Next, explanation follows regarding a case in which a pay-in transaction is performed in a state in which the high functionality versions of the respective modules are attached to the banknote pay-in/pay-out device 310, and the temporary holding section 333 is not mounted, namely in a state in which the banknote pay-in/pay-out device 310 is operating in the semi-high functionality mode, as illustrated in FIG. 30.

Similarly to in the high functionality mode, when banknotes have been inserted into the receptacle 331A, the high functionality customer interface 331H closes the shutter 331B and uses the separation section 331C to separate and pass the banknotes across to the front conveyance section 314A (FIG. 22) in sequence one note at a time. The front conveyance section 314A conveys the banknotes to the high functionality classification section 32H, as shown by the arrow W29. The high functionality classification section 32H classifies the conveyed banknotes in sequence and supplies the banknote controller 315 with classification results. The banknote controller 315 determines the conveyance state, denomination, authenticity, condition, and the like of the banknotes based on the obtained classification results, and decides the conveyance destinations of the banknotes based on the determination results.

Specifically, when a banknote has a normal conveyance state and the denomination is correctly identified, the banknote controller 315 conveys the banknote to the high functionality banknote storage box 335H of the corresponding denomination to be stored in sequence, as shown by the arrow W30. The banknote controller 315 also takes and stores a running tally of the denominations and number of the stored banknotes.

However, in cases in which a banknote cannot be determined to be normal based on the conveyance state, denomination, or the like, the banknote controller 315 deems this banknote to be a pay-in reject banknote, and performs what is referred to as a switchback operation. Namely, the banknote controller 315 halts conveyance of the banknote, conveys the pay-in reject banknote and other banknotes currently being conveyed back to the high functionality customer interface 331H, and opens the shutter 331B to return the banknotes to the user along with other banknotes remaining in the receptacle 331A. The banknote controller 315 repeats the processing routine when the user reinserts the banknotes in the receptacle 331A.

Finally, when the banknote controller 315 has completed classification of all of the banknotes inserted into the high functionality customer interface 331H using the high functionality classification section 32H, the banknote controller 315 adds up the total value (also referred to below as the pay-in amount) of the paid in banknotes, and while displaying a specific confirmation screen on the operation and display section 6 (FIG. 1), prompts the user to confirm the pay-in amount and instruct whether or not to continue with the pay-in transaction.

When the user gives an instruction to continue with the pay-in transaction, the banknote controller 315 completes the pay-in transaction. However, when an instruction to abandon the pay-in transaction is given, the banknote controller 315 conveys banknotes to the high functionality customer interface 331H similarly to in a pay-out transaction, in denominations and numbers corresponding the stored pay-in amount, returns the banknotes to the user, and ends the pay-in transaction.

4-4. Operation and Advantageous Effects

In the banknote pay-in/pay-out device 310 according to the fourth exemplary embodiment configured as described above, the respective high functionality mode and low functionality versions of the modules (the customer interface 331, the classification section 32, and the high functionality banknote storage boxes 335) may be attached to the customer interface attachment point 316, the classification section attachment point 317, and the banknote storage attachment points 325. Moreover, the banknote pay-in/pay-out device 310 may be put into operation in either a state in which the temporary holding section 333 is attached to the temporary holding section attachment point 318, or a state in which the temporary holding section 333 has been removed from the temporary holding section attachment point 318.

Similarly to in the first exemplary embodiment, the banknote pay-in/pay-out device 310 is thereby capable of operating in the low functionality mode if the low functionality versions of the respective modules, namely the low functionality customer interface 331L, the low functionality classification section 32L, and the low functionality banknote storage boxes 335L are attached (FIG. 25). In such cases, the banknote pay-in/pay-out device 310 is capable of functioning as what is referred to as a cash dispenser that is capable of processing that does not involve pay-in by a user, specifically transaction processing such as pay-out transactions, balance enquiries, and the like.

Moreover, the banknote pay-in/pay-out device 310 is capable of operating in the high functionality mode if the high functionality versions of the respective modules, namely the high functionality customer interface 331H, the high functionality classification section 32H, and the high functionality banknote storage boxes 335H are attached, and the temporary holding section 33 is also attached (FIG. 24).

In such cases, the banknote pay-in/pay-out device 310 is capable of functioning as what is referred to as an ATM, capable of various transaction processing involving pay-in, such as user pay-in transactions, in addition to the respective functions of a cash dispenser.

Moreover, in cases in which the high functionality versions of the respective modules are attached, but the temporary holding section 333 is not mounted, although the banknote pay-in/pay-out device 310 is not capable of operating in the high functionality mode, the banknote pay-in/pay-out device 310 is capable of operating in the semi-high functionality mode.

In such cases, the banknote pay-in/pay-out device 310 consecutively stores banknotes paid in by a user in the high functionality banknote storage boxes 335H. Namely, the banknote pay-in/pay-out device 310 stores the paid in banknotes in the high functionality banknote storage boxes 335H, without segregating them from other banknotes, at a point prior to asking the user whether or not to continue with the pay-in transaction, namely at a point before all of the paid in banknotes have been classified and the pay-in amount has been confirmed.

Accordingly, in the banknote pay-in/pay-out device 310, when an instruction to abandon the pay-in transaction is given, although it may not be possible to return the exact same banknotes that have been paid in, due to at least returning banknotes corresponding to the pay-in amount to the user, there are no issues as far as the transaction is concerned. Accordingly, the banknote pay-in/pay-out device 310 is capable of performing pay-in transactions as normal in the semi-high functionality mode in which the temporary holding section 333 is not attached.

In other respects, the banknote pay-in/pay-out device 310 according to the fourth exemplary embodiment is capable of achieving similar operation and advantageous effects to the banknote pay-in/pay-out device 10 according to the first exemplary embodiment.

According to the above configuration, the banknote pay-in/pay-out device 310 according to the fourth exemplary embodiment operates in the semi-high functionality mode in cases in which the high functionality versions of the respective modules are attached, but the temporary holding section 333 is not mounted. Accordingly, when the banknote pay-in/pay-out device 310 is operating in the semi-high functionality mode, although it may not be possible to return the exact same banknotes that have been paid in when a pay-in transaction is abandoned, pay-in transactions may still be performed without any issues as far as the transaction is concerned.

5. Other Exemplary Embodiments

Note that in the first exemplary embodiment described above, explanation has been given regarding a case in which the respective low functionality versions and high functionality versions of the modules may be selectively attached at three locations of the banknote pay-in/pay-out device 10, namely the customer interface attachment point 16, the classification section attachment point 17, and the banknote storage attachment points 25. However, exemplary embodiments are not limited thereto, and not all three locations need to allow exchange between low functionality versions and high functionality versions of the modules. For example, a fixed customer interface 31 may be attached in place of the customer interface attachment point 16. Moreover, configuration may be made in which various locations other than these three locations may be exchanged or added to. For example, in the upper conveyance section 14, a switching device disposed in the vicinity of the temporary holding section attachment point 18 may be exchangeable with a non-switching conveyance path in cases in which the temporary holding section 33 is not attached. Similar also applies in the second to the fourth exemplary embodiments. In particular, in the fourth exemplary embodiment, the second reject box 319 may be configured so as to be detachable.

In the exemplary embodiment described above, explanation has been given regarding a case in which the temporary holding section 33 is detachable with respect to the temporary holding section attachment point 18 of the banknote pay-in/pay-out device 10. However, the exemplary embodiment is not limited thereto, and for example, a fixed temporary holding section 33 may be attached in place of the temporary holding section attachment point 18. Similar also applies in the second to the fourth exemplary embodiments.

Moreover, in the first exemplary embodiment described above, explanation has been given regarding a case in which there are two operation modes depending on the type of modules attached, namely the high functionality mode and the low functionality mode, and in the second and the fourth exemplary embodiments, explanation has been given regarding cases in which there are three operation modes, with the respective additions of the semi-low functionality mode or the semi-high functionality mode. However, exemplary embodiments are not limited thereto, and for example, four or more operation modes may be switched. In such cases, it is preferable to switch to an operation mode capable performing transactions that effectively exploit the functionality of the attached modules. Alternatively, as in the third exemplary embodiment, configuration may be made in which flags, indicating the type of and whether or not the modules are attached, are set as appropriate, and the type and contents of the processing that is executed is switched according to the status of the flags.

Moreover, in the first exemplary embodiment described above, explanation has been given regarding a case in which, when deciding the operation mode of the banknote pay-in/pay-out device 10, even in a state in which operation in the high functionality mode is possible, it is possible to deliberately operate in the low functionality mode in accordance with an operation instruction given by a maintenance technician or the like at the operation mode selection screen D1 (FIG. 9). However, exemplary embodiments are not limited thereto, and as in the fourth exemplary embodiment, for example, configuration may be made such that operation in the high functionality mode is compulsory in a state in which operation in the high functionality mode is possible. Similar also applies in the second and third exemplary embodiments. Moreover, in the fourth exemplary embodiment, configuration may be made in which, similarly to in the first exemplary embodiment, the operation mode selection screen D1 accepts an operation mode selection instruction.

Moreover, in the first exemplary embodiment described above, explanation has been given regarding a case in which only the thickness sensor 32A is provided to the low functionality classification section 32L (FIG. 3D). However, exemplary embodiments are not limited thereto, and, for example, an optical sensor may be provided in addition to the thickness sensor 32A. In such an optical sensor, a light emitting element and a light receiving element are respectively disposed at positions facing each other across the banknote conveyance path 32Y, and a specific detection light is emitted from the light emitting element, and received by the light receiving element. The banknote controller 15 is capable of detecting banknote conveyance states with higher precision based on whether or not the detection light is blocked, as well as the duration, interval, and the like at which the detection light is blocked, and the detection results of the thickness sensor 32A. Various other sensors capable of detecting banknote conveyance states may also be provided to the low functionality classification section 32L. Similar also applies in the second to fourth exemplary embodiments.

Moreover, in the third exemplary embodiment described above, explanation has been given regarding a case in which the forgotten-banknote storage box 236 is attached inside the upper section unit 212 (FIG. 17, etc.). However, exemplary embodiments are not limited thereto, and, for example, a counterfeit note storage box for storing counterfeit notes, or a second reject box with similar functionality to the reject box 34, may be attached in place of the forgotten-banknote storage box 236. In such cases, it is sufficient to switch the type of transaction processing that may be carried out and the processing contents according to the type of module that is attached. In cases in which a second reject box is provided, for example, a reject box 234 may be omitted from the lower section unit 213. This thereby enables an increase in the number of the banknote storage boxes 35 that may be loaded in the lower section unit 213, and an increase in the total number of banknotes that may be stored. Moreover, similarly to the forgotten-banknote storage box 236 of the third exemplary embodiment, the second reject box 319 of the fourth exemplary embodiment may be configured so as to be detachable with respect to the banknote pay-in/pay-out device casing 311, and moreover, other types of modules may be attached.

Moreover, in the fourth exemplary embodiment described above, explanation has been given regarding a case in which pay-in reject banknotes are stopped and stored on the conveyance path inside the rear conveyance section 314D (FIG. 24). However, exemplary embodiments are not limited thereto, and, for example, a storage box capable of storing and feeding out banknotes may be provided in place of the second reject box 319, and pay-in reject banknotes may be stored in this storage box.

Moreover, in the first exemplary embodiment described above, explanation has been given regarding a case in which the identification numbers that differ by module type are stored in the non-volatile memory of each module, and the banknote controller 15 automatically identifies the module type based on the identification number. However, exemplary embodiments are not limited thereto, and, for example, configuration may be made in which a specific sensor is provided to the customer interface attachment point 16, a non-detection location that may be detected by this sensor is provided only to the high functionality customer interface 31H, and the module type is recognized based on a detection result of this sensor. Alternatively, configuration may be made in which a maintenance technician or the like registers the attached module type in a manual operation. In such cases, the banknote controller 15 may decide the operation mode based on the registered details. Similar also applies in the second to fourth exemplary embodiments.

Moreover, in the first exemplary embodiment described above, explanation has been given regarding a case in which the high functionality customer interface 31H and the low functionality customer interface 31L (FIG. 3) are prepared as mutually different modules, and one or the other is attached to the customer interface attachment point 16. However, exemplary embodiments are not limited thereto, and configuration may be made in which each individual module may be upgraded to the high functionality version. For example, the low functionality customer interface 31L may be made to achieve similar functionality to the high functionality customer interface 31H by attaching a component configuring the separation section 31C (FIG. 3A) either additionally, or by exchanging part of the low functionality customer interface 31L. Similar also applied for the other modules, such as the classification section 32, and similar also applies in the second to fourth exemplary embodiments.

Moreover, in the first exemplary embodiment described above, explanation has been given regarding a case in which the customer interface attachment point 16 is configured by the space in which to place the customer interface 31, the fixing member for fixing the customer interface 31 to the banknote pay-in/pay-out device casing 11, and the connector or the like for electrically connecting the customer interface 31 to the banknote controller 15 and the like. However, exemplary embodiments are not limited thereto, and, for example, a quick attachment/detachment mechanism that enables easy attachment and removal may be employed in place of the fixing member. Namely, it is sufficient that different types of module may be exchanged and made to function. Similar also applies to the classification section attachment point 17, the temporary holding section attachment point 18, and the banknote storage attachment points 25. Similar also applies in the second to fourth exemplary embodiments, and similar also applies to the forgotten-banknote storage attachment point 219 of the third exemplary embodiment.

Moreover, in the first exemplary embodiment described above, explanation has been given regarding a case in which the present disclosure is applied to the banknote pay-in/pay-out device 10 of the ATM 1. However, exemplary embodiments are not limited thereto, and application may be made to various devices that handle banknotes, such as a banknote sorting device (what is referred to as a teller machine) installed at a service counter in a financial institution, and employed principally by staff of the financial institution. Similar also applies in the second to fourth exemplary embodiments.

Moreover, in the first exemplary embodiment described above, explanation has been given regarding a case in which the present disclosure is applied to the ATM 1 that handles banknotes as a medium. However exemplary embodiments are not limited thereto, and, for example, application may be made to devices that handle various media, such as various types of cash vouchers or bills.

Moreover, the present disclosure is not limited to the respective exemplary embodiments described above, nor to the other exemplary embodiments described above. Namely, the present disclosure encompasses application to exemplary embodiments appropriately combining some or all of the respective exemplary embodiments described above and the other exemplary embodiments described above, and exemplary embodiments deriving from elements thereof.

Moreover, in the exemplary embodiments described above, explanation has been given regarding cases in which the ATM 1, serving as a medium transaction device, is configured by the upper conveyance section 14 and the lower conveyance section 21, serving as conveyance sections, the customer interface attachment point 16, serving as a customer interface attachment point, the classification section attachment point 17, serving as a classification section attachment point, the banknote storage attachment points 25, serving as storage section attachment points, and the banknote controller 15, serving as a controller. However exemplary embodiments are not limited thereto, and a medium transaction device may be configured by conveyance sections, customer interface attachment points, classification section attachment points, storage section attachment points, and controllers of various other configurations.

INDUSTRIAL APPLICABILITY

The present disclosure may be employed in ATMs that transact banknotes, serving as a medium, with a user.

The invention claimed is:

1. A medium transaction device comprising:

a conveyance section that conveys a medium;

a customer interface attachment point for attaching a customer interface to a casing, the customer interface including at least one of a handover function to receive the medium from the conveyance section and hand over the medium to a user or a receiving function to receive the medium from the user and pass the medium across to the conveyance section;

a classification section attachment point for attaching a classification section that classifies the medium conveyed by the conveyance section to the casing;

a storage section attachment point for attaching, to the casing, a storage section that stores the medium; and a controller that controls transaction processing of the medium with the user, wherein:

at least one of the customer interface attachment point, the classification section attachment point, or the storage section attachment point is configured so as to allow attachment of a plurality of mutually different respective functional types of the customer interface, the classification section, or the storage section, and so as to be attached with one type of the customer interface, the classification section, or the storage section;

either a low functionality customer interface including the handover function, or a high functionality customer interface including both the handover function and the receiving function, is attached to the customer interface attachment point;

either a low functionality classification section that classifies a conveyance state of the medium, or a high functionality classification section that classifies at least the authenticity of the medium in addition to the conveyance state, is attached to the classification section attachment point;

either a low functionality storage section including a feed-out function to feed out and pass the medium to be handed over to the user across to the conveyance section, or a high functionality storage section including in addition to the feed-out function a storage function to take in and store the medium received from the user and conveyed by the conveyance section, is attached to the storage section attachment point; and the controller makes a handover transaction in which the medium is handed over to the user and a receiving transaction in which the medium is received from the user executable in cases in which the high functionality customer interface is attached to the customer interface attachment point, the high functionality classification section is attached to the classification section attachment point, and the high functionality storage section is attached to the storage section attachment point, and the controller makes the receiving transaction non-executable and the handover transaction executable in all other cases.

2. The medium transaction device of claim 1, further comprising a temporary storage section attachment point for attaching, to the casing, a temporary storage section that temporarily stores or feeds out the medium being transacted with the user during a single occasion of the transaction processing, wherein:

the controller switches the transaction processing executable with the user according to the type of the customer interface, the classification section, or the storage section that is attached to the customer interface attachment point, the classification section attachment point, or the storage section attachment point, and according to whether or not the temporary storage section is attached to the temporary storage section attachment point.

3. The medium transaction device of claim 1, further comprising a temporary storage section attachment point for attaching, to the casing, a temporary storage section that temporarily stores or feeds out the medium transacted with the user during a single occasion of the transaction processing, wherein:

the controller makes the handover transaction and the receiving transaction executable in cases in which the high functionality customer interface is attached to the customer interface attachment point, the high functionality classification section is attached to the classification section attachment point, the high functionality storage section is attached to the storage section attachment point, and the temporary storage section is also attached to the temporary storage section attachment point, and the controller makes the receiving transaction non-executable and makes the handover transaction executable in all other cases.

4. The medium transaction device of claim 1, further comprising a forgotten-medium storage section attachment point for attaching, to the casing, a forgotten-medium storage section that stores forgotten-medium the user has forgotten to take from the customer interface during the handover transaction, wherein:

in cases in which the high functionality customer interface is attached to the customer interface attachment point and the forgotten-medium storage section is attached to the forgotten-medium storage section attachment point, the controller passes the forgotten-medium across to the conveyance section using the receiving function of the high functionality customer interface, conveys the forgotten-medium to the forgotten-medium storage section using the conveyance section, and stores the forgotten-medium, and then accepts the next occasion of the transaction processing.

5. The medium transaction device of claim 1, wherein, the controller is able to set a no-receiving-transactions setting making the receiving transaction non-executable, and in cases in which the no-receiving-transactions setting has been set, the controller makes the receiving transaction non-executable irrespective of the type of the customer interface, the classification section, or the storage section respectively attached to the customer interface attachment point, the classification section attachment point, and the storage section attachment point.

6. A medium transaction device comprising:

a conveyance section that conveys a medium;

a customer interface attachment point for attaching a customer interface to a casing, the customer interface including at least one of a handover function to receive the medium from the conveyance section and hand over the medium to a user or a receiving function to receive the medium from the user and pass the medium across to the conveyance section;

a classification section attachment point for attaching a classification section that classifies the medium conveyed by the conveyance section to the casing;

a storage section attachment point for attaching, to the casing, a storage section that stores the medium; and a controller that controls transaction processing of the medium with the user, wherein:

at least one of the customer interface attachment point, the classification section attachment point, or the storage section attachment point is configured so as to allow attachment of a plurality of mutually different respective functional types of the customer interface, the classification section, or the storage section, and so as to be attached with one type of the customer interface, the classification section, or the storage section; and the controller detects the type of the customer interface, the classification section, and the storage section respectively attached to the customer interface attachment point, the classification section attachment point, and the storage section attachment point, and switches the transaction processing executable with the user based on an obtained detection result.

7. The medium transaction device of claim 6, further comprising a temporary storage section attachment point for attaching, to the casing, a temporary storage section that temporarily stores or feeds out the medium being transacted with the user during a single occasion of the transaction processing, wherein:

the controller detects the type of the customer interface, the classification section, and the storage section, and whether or not the temporary storage section is attached to the temporary storage section attachment point, and switches the transaction processing executable with the user based on an obtained detection result.

* * * * *